US010031442B2

(12) United States Patent
Isobe et al.

(10) Patent No.: US 10,031,442 B2
(45) Date of Patent: Jul. 24, 2018

(54) REMANUFACTURING METHOD OF DEVELOPER ACCOMMODATING UNIT

(71) Applicant: CANON KABUSHIKI KAISHA, Tokyo (JP)

(72) Inventors: Yuta Isobe, Kawasaki (JP); Takashi Kase, Tokyo (JP); Kouki Yano, Kawasaki (JP); Takahiro Ikeda, Oyama (JP); Yusuke Usui, Tokyo (JP); Shinjiro Toba, Yokohama (JP); Masaaki Sato, Yokohama (JP); Yosuke Kashiide, Tokyo (JP); Satoshi Nishiya, Machida (JP); Tatsuya Suzuki, Kawasaki (JP); Kohei Matsuda, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/874,741

(22) Filed: Jan. 18, 2018

(65) Prior Publication Data

US 2018/0143569 A1 May 24, 2018

Related U.S. Application Data

(63) Continuation of application No. 15/359,382, filed on Nov. 22, 2016, now Pat. No. 9,910,387, which is a continuation of application No. 14/920,316, filed on Oct. 22, 2015, now Pat. No. 9,535,372.

(30) Foreign Application Priority Data

Oct. 27, 2014 (JP) ..... 2014-218519

(51) Int. Cl.
*G03G 15/08* (2006.01)

(52) U.S. Cl.
CPC ..... *G03G 15/0894* (2013.01); *G03G 15/0874* (2013.01)

(58) Field of Classification Search
CPC ..... G03G 15/0894; G03G 15/0865; G03G 15/0882; G03G 2215/00987; G03G 2215/0863; G03G 21/181
See application file for complete search history.

(56) References Cited

U.S. PATENT DOCUMENTS 5,802,431 A * 9/1998 Nagashima ..... G03G 15/0855 222/DIG. 1
2002/0041774 A1* 4/2002 Higeta ..... G03G 21/181 399/109
2014/0072346 A1* 3/2014 Furutani ..... G03G 15/0865 399/262

(Continued)

FOREIGN PATENT DOCUMENTS

JP 08171281 A * 7/1996
JP 2002002832 A 1/2002

(Continued)

*Primary Examiner* — Francis Gray
(74) *Attorney, Agent, or Firm* — Canon USA, Inc. IP Division

(57) ABSTRACT

Provided is a remanufacturing method of a developer accommodating unit including a flexible container provided with an opening and configured to accommodate developer, and a frame member configured to accommodate the flexible container. The remanufacturing method includes refilling the developer into the flexible container.

18 Claims, 34 Drawing Sheets

(56) References Cited

U.S. PATENT DOCUMENTS

| | | | | |
|---|---|---|---|---|
| 2015/0139684 | A1* | 5/2015 | Nakazawa | G03G 15/0874 399/106 |
| 2015/0234319 | A1* | 8/2015 | Matsumura | B65B 51/10 399/111 |

FOREIGN PATENT DOCUMENTS

| | | | | |
|---|---|---|---|---|
| JP | 2003057933 | A | | 2/2003 |
| JP | 2003107875 | A | * | 4/2003 |
| JP | 2003208003 | A | * | 7/2003 |
| JP | 2004161371 | A | | 6/2004 |
| JP | 2006267679 | A | * | 10/2006 |
| JP | 2012226277 | A | | 11/2012 |
| JP | 5197326 | B2 | | 5/2013 |
| JP | 2014032426 | A | | 2/2014 |
| JP | 201518951 | A | * | 11/2015 |

* cited by examiner 251
251F
L1
L2
L3
L4
L5
L6
L7
L8
L9
251h1
251h2
251h3
251h4
251h5
251h6
251h7
251h8
251h9
251h10
251h

251
L1
251F 251
251F
L10

251
251F
251h11

REMANUFACTURING METHOD OF DEVELOPER ACCOMMODATING UNIT

CROSS-REFERENCE TO RELATED APPLICATIONS

This application is a continuation of U.S. patent application Ser. No. 15/359,382 filed Nov. 22, 2016, which is a continuation of U.S. patent application Ser. No. 14/920,316 filed Oct. 22, 2015, now U.S. Pat. No. 9,535,372 issued Jan. 3, 2017, which claims the benefit of Japanese Patent Application No. 2014-218519, filed Oct. 27, 2014, all of which are hereby incorporated by reference herein in their entirety.

BACKGROUND OF THE INVENTION

Field of the Invention

The present invention relates to a remanufacturing method of a developer accommodating unit for refilling a developer.

An image forming apparatus forms an image on a recording medium using an electrophotographic image forming process. Examples of image forming apparatuses include electrophotographic copying machines, electrophotographic printers (for example, laser beam printers and light emitting diode (LED) printers), facsimile apparatuses, and word processors.

A developing device includes developer, and a developing roller as a developer bearing member for developing an electrostatic latent image formed on a photosensitive drum as an image bearing member. The developing device is detachably attached to an image forming apparatus or a photosensitive drum unit including a photosensitive drum.

A cartridge (process cartridge) integrally includes a photosensitive drum and a developing roller, and is detachably attached to an image forming apparatus.

Description of the Related Art

Japanese Patent No. 3320403 discloses a remanufacturing method of a cartridge having a developing device, more specifically, a remanufacturing method of a cartridge for refilling, using a funnel, toner into a storage container for storing toner, after removing a developing roller and a developing blade.

SUMMARY OF THE INVENTION

The present invention is directed to a remanufacturing method of a developer accommodating unit including a flexible container.

According to an aspect of the present invention, a remanufacturing method of a developer accommodating unit including a flexible container provided with an opening and configured to accommodate developer, and a frame member configured to accommodate the flexible container, includes refilling the developer into the flexible container.

Further features of the present invention will become apparent from the following description of embodiments with reference to the attached drawings.

DESCRIPTION OF THE EMBODIMENTS

Figure 1:
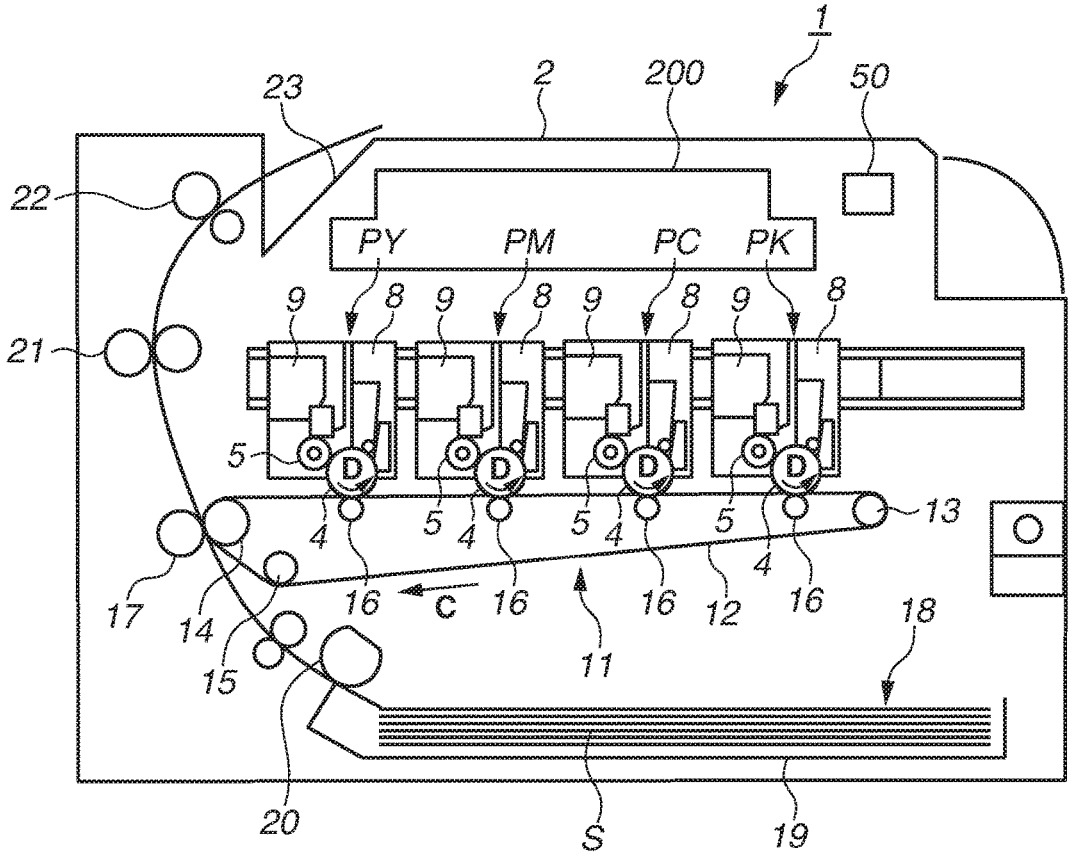
FIG. 1 is a sectional view illustrating an image forming apparatus.

Embodiments of the present invention will be described in detail below with reference to the accompanying drawings. However, sizes, materials, shapes, and relative positions of elements described in the embodiments are not limited thereto, and can be appropriately modified depending on the configuration of an apparatus according to the present invention and other various conditions. Unless otherwise specifically described, the scope of the present invention is not limited to the embodiments described below. Elements in subsequent embodiments that are identical to those in preceding embodiments are assigned the same reference numerals, and descriptions in the preceding embodiments will be incorporated by reference.

In the following descriptions, a developer accommodating unit includes at least a frame member and a flexible container. A developing device includes at least a developer bearing member. Further, a process cartridge includes at least an image bearing member. In the embodiments, a developer accommodating unit is equal to a developing device. In the embodiments, a developing unit may be independently configured as a developing device.

First Embodiment

FIG. 1 is a sectional view illustrating an image forming apparatus 1. The image forming apparatus 1 performs full color image formation, and is provided with an apparatus body 2. Inside the apparatus body 2, four cartridges P are detachably attached. In the following descriptions of the image forming apparatus 1, the front surface is on the right side, the rear surface is on the left side, the drive side is on the rear side, and the non-drive side is on the front side, as illustrated in FIG. 1. The cartridges P attached to the apparatus body 2 are the following four cartridges: a first cartridge PY, a second cartridge PM, a third cartridge PC, and a fourth cartridge PK. These cartridges P are disposed in a horizontal direction.

These cartridges P have an approximately similar configuration expect for different toner colors. The first cartridge PY accommodates yellow developer, the second cartridge PM accommodates magenta developer, the third cartridge PC accommodates cyan developer, and the fourth cartridge PK accommodates black developer. The image forming apparatus 1 performs color image formation on a recording material S. The image forming apparatus 1 is a cartridge type image forming apparatus in which the cartridges P are detachably attached to the apparatus body 2 and a color image is formed on the recording material S.

A mechanism inside the cartridge P is driven by a rotational driving force received from a drive output unit (not illustrated) of the apparatus body 2. Internal devices in the cartridge P is supplied with bias voltages (a charging bias voltage, a developing bias voltage, etc.) from the apparatus body 2.

An exposure device 200 is disposed above the plurality of cartridges P. The exposure device 200 is a laser scanner unit for irradiating a photosensitive drum 4 with laser light LS based on information transmitted from a controller 50 in the apparatus body 2. This laser light LS passes through an exposure window portion 10 (refer to FIG. 2) inside the cartridge P, and the surface of the photosensitive drum 4 is exposed to the laser light LS to be scanned.

An intermediate transfer belt unit 11 is disposed below the plurality of cartridges P. The intermediate transfer belt unit 11 includes a transfer belt 12, and a drive roller 13 and tension rollers 14 and 15 for stretching the transfer belt 12. The transfer belt 12 is made of a flexible material.

The bottom surface of the photosensitive drum 4 inside the cartridge P contacts the upper surface of the transfer belt 12. The relevant contact portion is a primary transfer portion. Inside the transfer belt 12, primary transfer rollers 16 are disposed to surface respective photosensitive drums 4. A secondary transfer roller 17 is disposed at a position facing the tension roller 14 via the transfer belt 12. The contact portion between the secondary transfer roller 17 and the transfer belt 12 is a secondary transfer portion.

A feed unit 18 is disposed below the intermediate transfer belt unit 11. The feed unit 18 includes a tray 19 on which recording materials S are stacked, and a feed roller 20. A fixing unit 21 and a discharge unit 22 are disposed at the upper left position of the cartridge P. A discharge tray 23 is formed on the upper surface of the apparatus body 2. The recording material S is fixed by the fixing unit 21 and then discharged onto the discharge tray 23.

Figure 2:
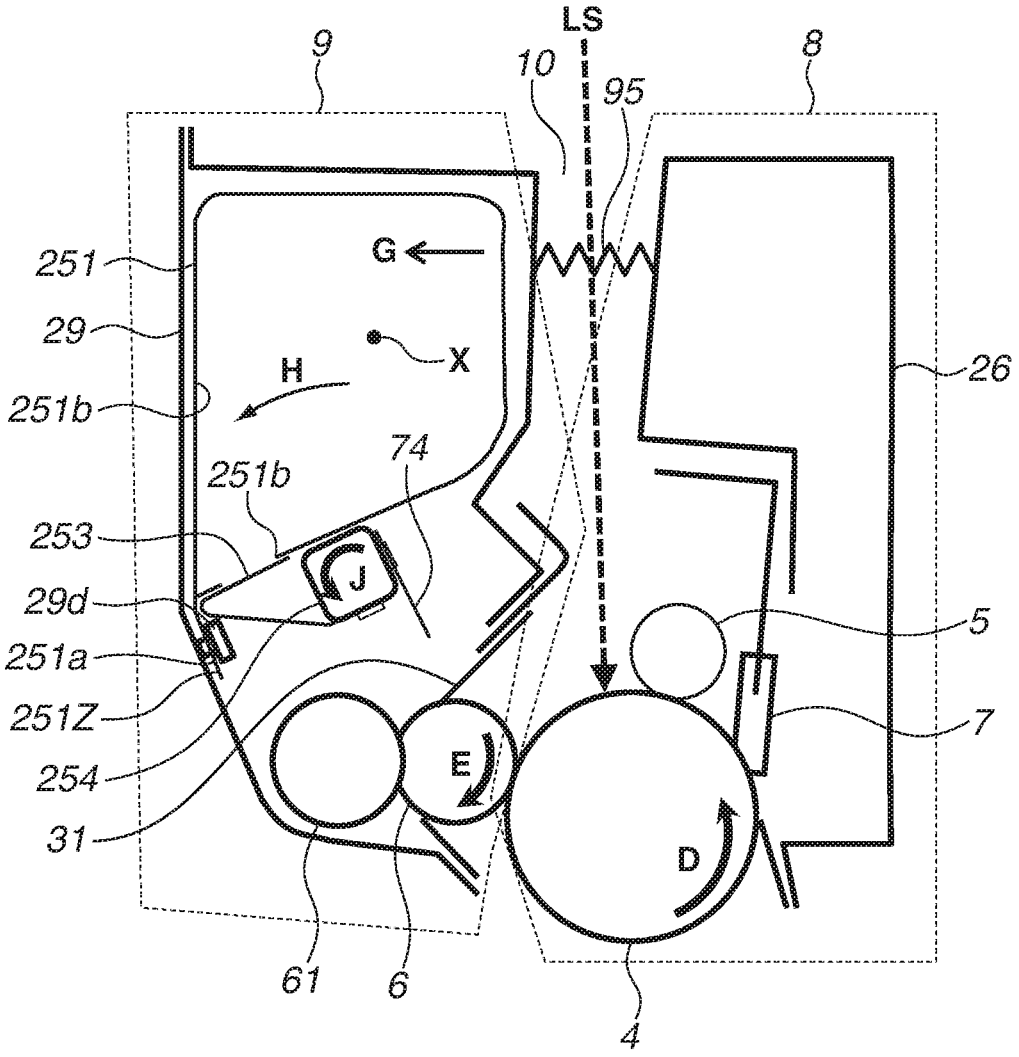
FIG. 2 is a sectional view illustrating a cartridge.

FIG. 2 is a sectional view illustrating the cartridge P. The cartridge P includes a photosensitive unit 8 and a developing unit 9 as a "developer accommodating unit". The photosensitive unit 8 includes the photosensitive drum 4 as an "image bearing member", a charging roller 5, and a cleaning member 7. The charging roller 5 uniformly charges the surface of the photosensitive drum 4. The cleaning member 7 is a blade for removing residual toner that has been developed on the surface of the photosensitive drum 4, but has not been transferred onto the primary transfer roller 16.

The developing unit 9 includes a developing roller 6 as a "developer bearing member", a supply roller 61, and an agitating member 74. The developing roller 6 develops an electrostatic image on the surface of the photosensitive drum 4 using toner. The supply roller 61 supplies developer to the developing roller 6. The agitating member 74 agitates the developer inside the developing unit 9.

Operations of the image forming apparatus 1 will be described below with reference to above-described FIGS. 1 and 2. The surface of the photosensitive drum 4 is uniformly charged by the charging roller 5 and then is exposed to light by the exposure device 200, so that an electrostatic image is formed on the surface of the photosensitive drum 4. When the electrostatic image is developed by the developing unit 9 using the developer, a developer image is formed. The developer image on the surface of the photosensitive drum 4 is transferred onto the transfer belt 12 rotating in a forward direction (the direction indicated by an arrow C illustrated in FIG. 1) of the rotational direction of the photosensitive drum 4. Yellow, magenta, cyan, and black developer images are primarily transferred sequentially from the respective photosensitive drums 4 of the first to the fourth cartridges P onto the transfer belt 12 to be superimposed upon one another.

Meanwhile, the recording materials S stacked on the tray 19 are separated and fed one by one according to a predetermined control timing. Each of the recording materials S is conveyed to the secondary transfer portion between the secondary transfer roller 17 and the transfer belt 12. At the secondary transfer portion, the developer image on the surface of the transfer belt 12 is secondarily transferred onto the recording material S.

The developing unit 9 includes a flexible container 251 for accommodating (storing) the developer, and a frame member 29 for accommodating (storing) the flexible container 251. The flexible container 251 is provided with openings 251*h* for discharging the developer. The developing unit 9 further includes a sealing member 253 for sealing the openings 251*h*, and exposing the openings 251*h* when being moved, and an unsealing member 254 attached to the sealing member 253 and for unsealing the openings 251*h* when being moved. In other words, the developing unit 9 refers to a unit including at least the flexible container 251, the sealing member 253, and the unsealing member 254 inside the frame member 29. The flexible container 251 includes an accommodating portion 251*b* for accommodating (storing) the developer T, and the openings 251*h* for discharging the developer T.

Figure 3:
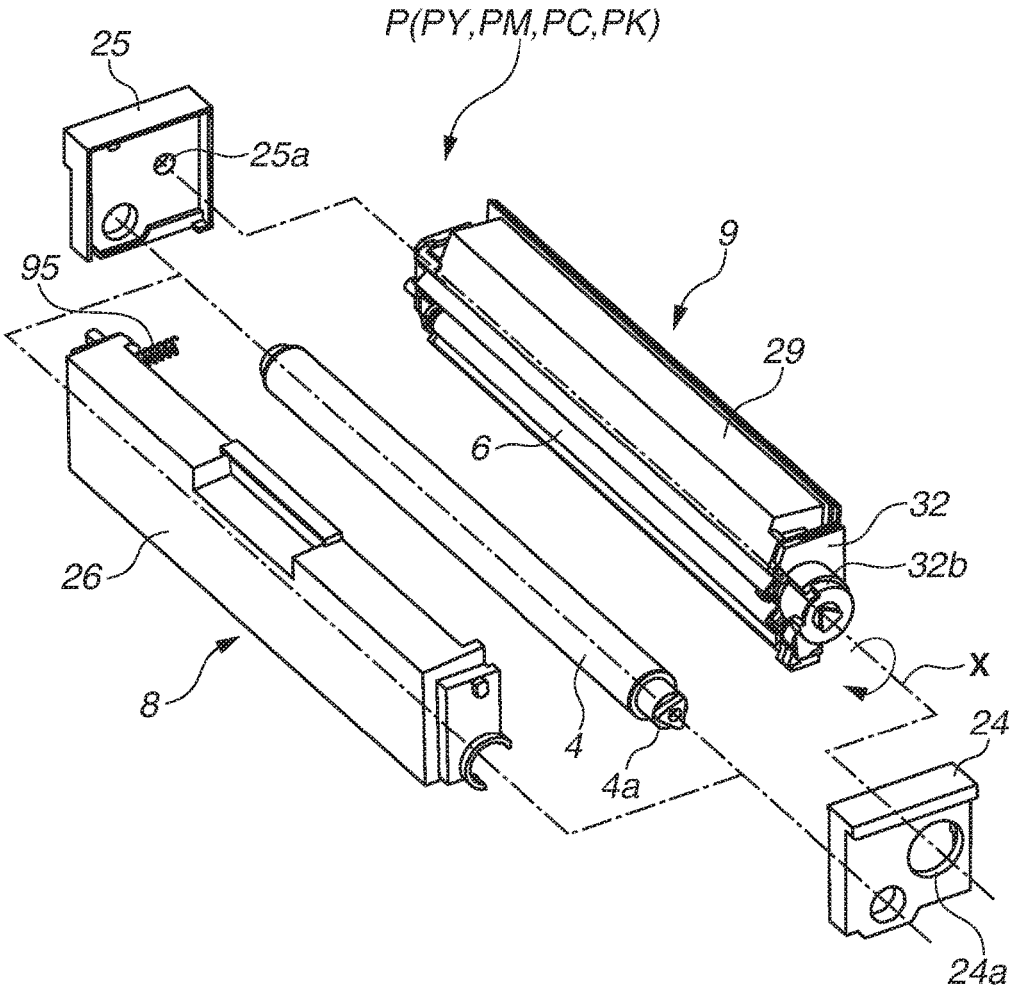
FIG. 3 is a perspective view illustrating the cartridge viewed from a drive side.
Figure 4:
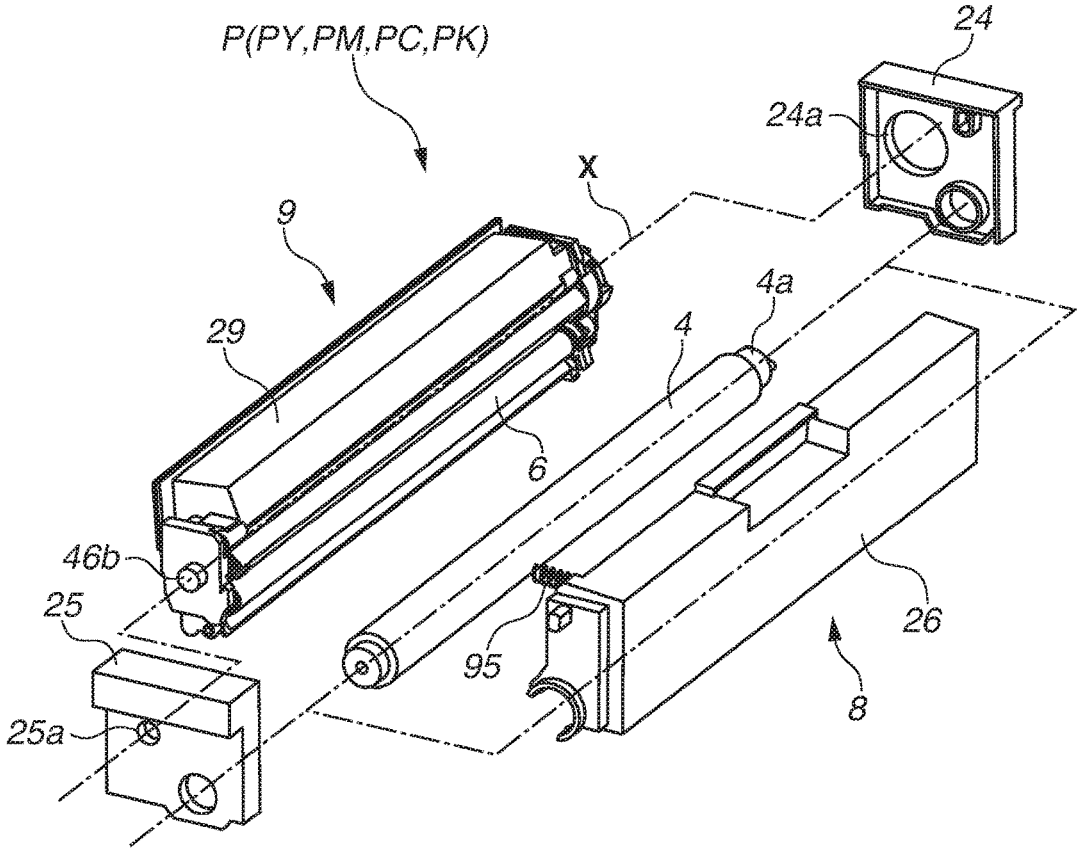
FIG. 4 is a perspective view illustrating the cartridge viewed from a non-drive side.

FIG. 3 is a perspective view illustrating the cartridge P viewed from the drive side. FIG. 4 is a perspective view illustrating the cartridge P viewed from the non-drive side. As illustrated in FIGS. 3 and 4, the photosensitive unit 8 and the developing unit 9 are integrally formed by covers 24 and 25. Therefore, the photosensitive unit 8 includes the photosensitive drum 4, the charging roller 5, the cleaning member 7, a cleaning container 26, and the covers 24 and 25. The photosensitive drum 4 is rotatably supported on the cleaning container 26 by the covers 24 and 25.

One end side of the photosensitive drum 4 in the longitudinal direction is provided with a coupling member 4*a* for transmitting a driving force to the photosensitive drum 4. When the coupling member 4*a* is engaged with a drum drive output unit of the apparatus body 2, the driving force of the drive motor (not illustrated) of the apparatus body 2 is transmitted to the photosensitive drum 4. The charging roller 5 is supported by the cleaning container 26 so that the charging roller 5 can be rotatably driven with being in contact with the photosensitive drum 4. The cleaning member 7 is supported by the cleaning container 26 so that the cleaning member 7 contacts the circumferential surface of the photosensitive drum 4 at a predetermined pressure.

Residual developer removed from the circumferential surface of the photosensitive drum 4 by the cleaning member 7 is stored in the cleaning container 26. Holes 24*a* and 25*a* for rotatably supporting the developing unit 9 are formed on the covers 24 and 25, respectively.

Figure 5:
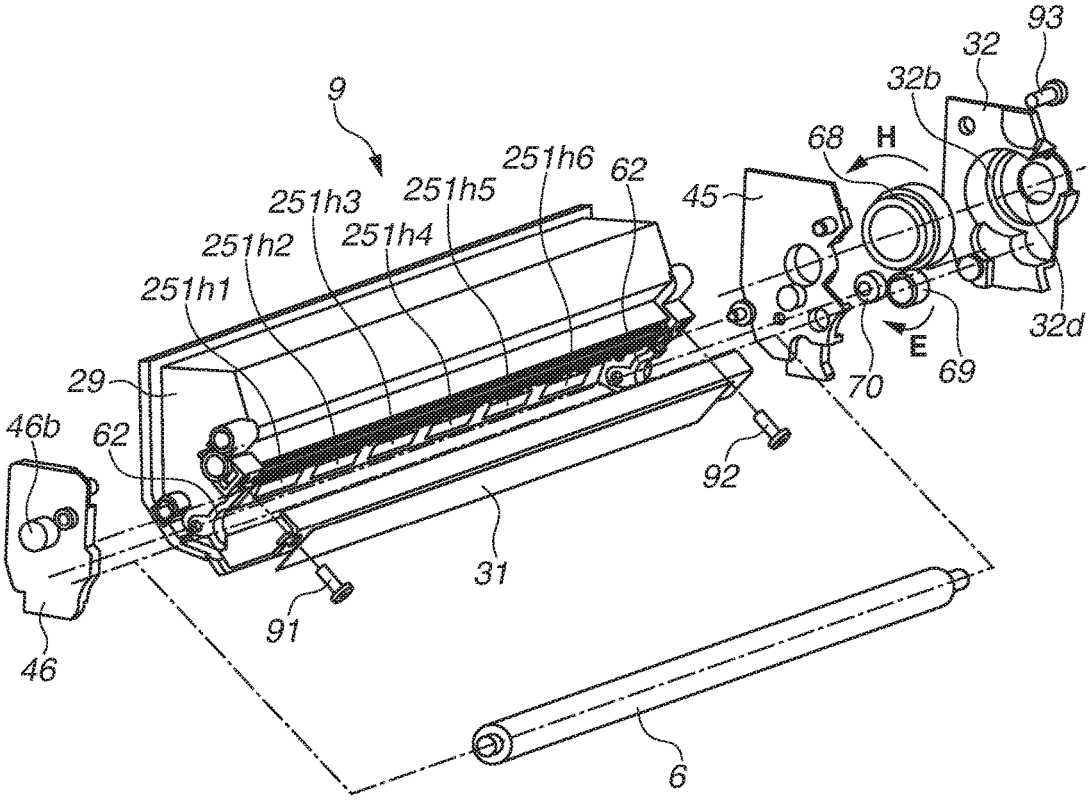
FIG. 5 is an exploded perspective view illustrating a developing unit.

FIG. 5 is an exploded perspective view illustrating the developing unit 9. The flexible container 251 is stored in the developing unit 9 illustrated in FIG. 5. As illustrated in FIG. 5, the developing unit 9 includes the developing roller 6, a developing blade 31, the frame member 29, bearings 45 and 46, and a cover 32.

As illustrated in FIG. 2, the frame member 29 is provided with a projection 29*d* as a "fixing member" for fixing a fixed member 251Z of the flexible container 251. The projection 29*d* is a portion to be inserted into a hole 251*a*. The flexible container 251 includes the fixed member 251Z on which the hole 251*a* to be fixed to the frame member 29 is formed, the accommodating portion 251*b* for accommodating (storing) the developer, and the openings 251*h* (251*h*1 to 251*h*6) for discharging the developer.

The hole 251*a* formed on the fixed member 251Z is a hole different from the openings 251*h*. When the hole 251*a* is hooked on the projection 29*d*, the flexible container 251 is fixed to the frame member 29. When the hole 251*a* is unhooked from the projection 29*d*, the flexible container 251 becomes separable from the frame member 29.

When the cartridge P is new, since the openings 251*h* (251*h*1 to 251*h*6) (refer to FIGS. 15A and 15B) are covered by the sealing member 253 detachably welded to the flexible container 251, the developer is sealed inside the flexible container 251.

The sealing member 253 is coupled to the unsealing member 254. The unsealing member 254 is supported so as to be rotatable in the direction indicated by an arrow J by receiving a driving force from the apparatus body 2. When the new cartridge P is used, the cartridge P is attached to the apparatus body 2. Then, the unsealing member 254 receives a driving force from the apparatus body 2 to rotate.

At this timing, the sealing member 253 is detached from the flexible container 251 and is rolled up by the unsealing member 254. Thus, the openings 251*h* (251*h*1 to 251*h*6) of the flexible container 251 are exposed, enabling the developer in the flexible container 251 to be discharged into the frame member 29.

The developing blade 31 for regulating the layer thickness of the developer on the circumferential surface of the developing roller 6 is fixed to the frame member 29 (refer to FIG. 5). The bearings 45 and 46 are fixed at both ends of the frame member 29 in the longitudinal direction. Gears 70, 69, and 68 are disposed on the drive side end. The shaft of the supply roller 61 is fitted into the gear 70. The shaft of the developing roller 6 is fitted into the gear 69. The shaft of the agitating member 74 (FIG. 2) is fitted into the gear 68.

The gear 69 is set to rotate when the gear 68 rotates. The bearing 45 is provided with the gears 68, 69, and 70. The cover 32 is fixed to the outside of the gears 68, 69, and 70. End seals 62 are disposed at both ends of the shaft of the supply roller 61 to seal between the supply roller 61 and the frame member 29.

As illustrated in FIG. 5, the cover 32 is provided with a cylindrical portion 32*b*. A drive transmission portion 68*a* of the gear 68 is exposed through an opening 32*d* inside the cylindrical portion 32*b*. When the cartridge P is attached to the apparatus body 2, the drive transmission portion 68*a* of the gear 68 is engaged with an apparatus body drive transmission member (not illustrated), so that a driving force from a drive motor (not illustrated) provided in the apparatus body 2 is transmitted. The driving force input from the apparatus body 2 to the gear 68 is transmitted to the developing roller 6 via the gear 69.

Photosensitive Unit and Developing Unit Assembling Process

As illustrated in FIGS. 3 and 4, when assembling the developing unit 9 and the photosensitive unit 8, the outer diameter portion of the cylindrical portion 32*b* of the cover 32 is fitted into the hole 24*a* of the cover 24 on one end side. Then, a protruding portion 46*b* protruding from the bearing 46 is fitted into the hole 25*a* of the cover 25 on the other end side. Thus, the developing unit 9 is supported so as to be rotatable with respect to the photosensitive unit 8. The developing unit 9 is rotatable around an axis line connecting the hole 24*a* of the cover 24 and the hole 25*a* of the cover 25. The rotation center of the developing unit 9 is referred to as a rotation center X.

As illustrated in FIG. 2, the developing unit 9 is urged by a pressure spring 95 as an elastic member so that the developing roller 6 contacts the photosensitive drum 4 around the rotation center X. More specifically, the developing unit 9 is pressed in the direction indicated by an arrow G illustrated in FIG. 2 by an urging force of the pressure spring 95 so that a moment in the direction indicated by an arrow H acts around the rotation center X.

Referring to FIG. 5, the gear 68 receives a rotational driving force in the direction indicated by the arrow H (refer to FIG. 2) from an apparatus body drive transmission member (not illustrated) provided on the apparatus body 2. The gear 69 engaged with the gear 68 thereby rotates in the direction indicated by an arrow E. Likewise, the developing roller 6 thereby rotates in the direction indicated by the arrow E. When a driving force required for rotating the developing roller 6 is input to the gear 68, a rotational moment in the direction indicated by the arrow H arises in the developing unit 9.

A pressing force of the above-described pressure spring 95 and a rotational driving force from the apparatus body 2 cause the developing unit 9 to receive a moment in the direction indicated by the arrow H around the rotation center X. Then, the developing roller 6 contacts the photosensitive drum 4 at a predetermined pressure. Although, in the first embodiment, two forces, i.e., the pressing force by the pressure spring 95 and the rotational driving force from the apparatus body 2 are used to press the developing roller 6 against the photosensitive drum 4, only either one force may be used for the relevant purpose.

With the cartridge P being attached to the inside of the apparatus body 2, image formation is performed while consuming the developer inside the developing unit 9. The remanufacturing method of the cartridge P of refilling the developer into the developing unit 9 after consuming the developer inside the developing unit 9 will be sequentially described below.

Unit Separation Process

The remanufacturing method of the developing unit 9 will be described below. A unit separation process for separating the photosensitive unit 8 and the developing unit 9 of the cartridge P will be described below. As illustrated in FIG. 3, when the covers 24 and 25 are removed from the cleaning container 26, the developing unit 9 and the photosensitive unit 8 can be separated. As described above, since the covers 24 and 25 and the cleaning container 26 rotatably support the photosensitive drum 4, the above-described unit separation process enables the separation of the photosensitive drum 4 from the photosensitive unit 8.

Developing Unit Disassembling Process

A process for disassembling the developing unit 9 will be described below with reference to FIG. 5. First of all, the cover 32 provided at the drive side end of the developing unit 9 is separated from the frame member 29. When the cover 32 is fixed to the bearing 45 and the frame member 29 with a screw 93, the screw 93 is removed and then the cover 32 is separated from the developing unit 9.

Then, on the drive side of the developing unit 9, the gears 68, 69, and 70 disposed inside the cover 32 in the longitudinal direction are separated from the developing unit 9. The gear 68 is slidably supported by the cover 32 and the bearing 45, and the gear 69 is fitted into an end of the shaft of the developing roller 6. The gear 70 is fitted into the shaft of the supply roller 61. Therefore, the gears 68, 69, and 70, the developing roller 6, and the supply roller 61 can be easily separated from the developing unit 9.

Then, the bearings 45 and 46 and the developing roller 6 are separated from the developing unit 9. When the bearing 45 is fixed to the frame member 29 with a screw, the screw is removed and then the bearing 45 is separated from the frame member 29. In the present embodiment, the bearing 45 and the cover 32 are fixed together to the frame member 29 with the screw 93. Since the screw 93 has been removed when the cover 32 is separated from the frame member 29, the bearing 45 can be easily separated from the frame member 29. Likewise, when the bearing 46 is fixed to the frame member 29 with a screw, the bearing 46 can be separated from the frame member 29 after the screw is removed.

As described above, the developing roller 6 is slidably supported on the frame member 29 by the bearings 45 and 46. Therefore, in a state where the bearings 45 and 46 are separated from the frame member 29, the developing roller 6 can be easily separated from the frame member 29. Although, in the above descriptions, a process for separating both the bearings 45 and 46 from the frame member 29 is performed to separate the developing roller 6 from the frame member 29, the method is not limited thereto. For example, after only the bearing 46 is separated from the frame member 29, the developing roller 6 may be pulled out toward the non-drive side to separate the developing roller 6 from the frame member 29.

Then, the developing blade 31 is separated from the frame member 29. When the developing blade 31 is fixed to the frame member 29 with screw 91 and 92, the screws 91 and 92 are removed and then the developing blade 31 is separated from the frame member 29.

Figure 14A:
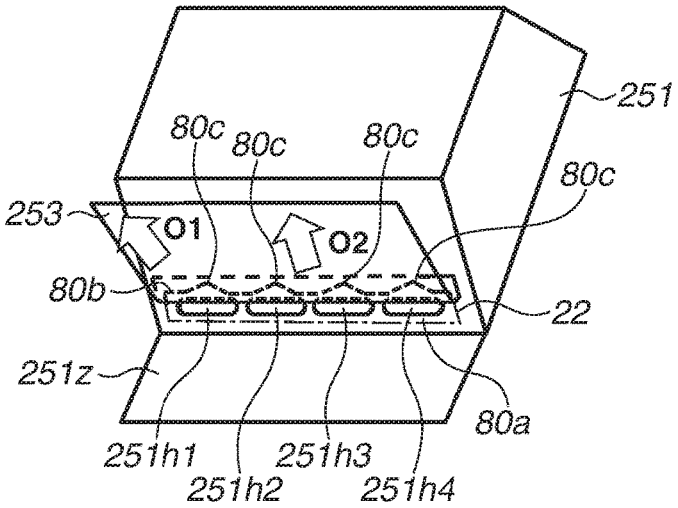
FIGS. 14A, 14B, and 14C are perspective views illustrating a process for detaching the sealing member from the flexible container.
Figure 14B:
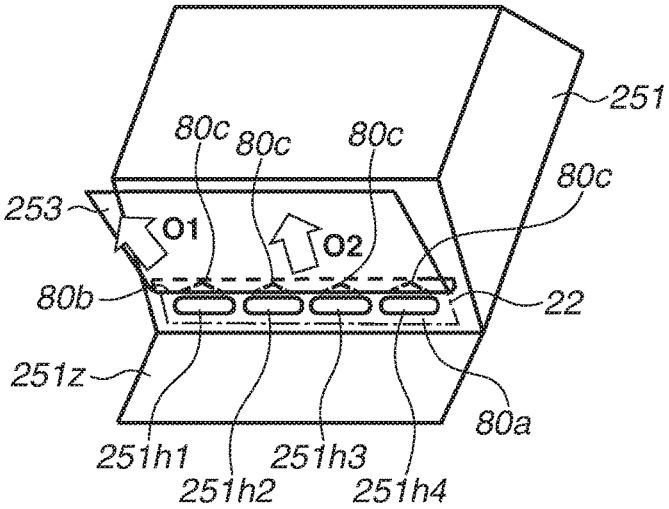
Figure 14C:
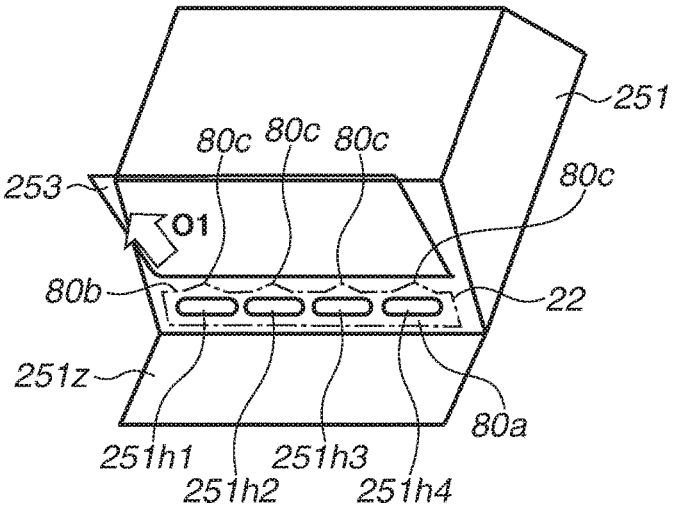

FIGS. 14A, 14B, and 14C are perspective views illustrating a process for detaching the sealing member 253 from the flexible container 251. The flexible container 251 is accommodated (stored) inside the frame member 29. When the unsealing member 254 rotates, the sealing member 253 is separated from an attachment and detachment area around the openings 251*h*1 to 251*h*4 of the accommodating portion 251*b* of the flexible container 251. Although four openings 251*h* are illustrated in FIGS. 14A, 14B, and 14C, there are six openings 251*h* in the present embodiment.

The attachment and detachment area has two different portions on the downstream side in the detachment direction: parallel portions 80*b* parallel to the axis direction of the developing roller 6, and mountain-shaped portions 80*c* having a mountain shape toward the downstream side in the detachment direction. The attachment and detachment area further includes a detachment start portion 80*a* parallel to the axis direction of the developing roller 6, at the upstream side in the detachment direction. The sealing member 253 is pulled in the direction indicated by an arrow O1 and the direction indicated by the arrow O2 to be detached in states illustrated in FIGS. 14A, 14B, and 14C in this order.

First Communication Hole Processing Process

Figure 6:
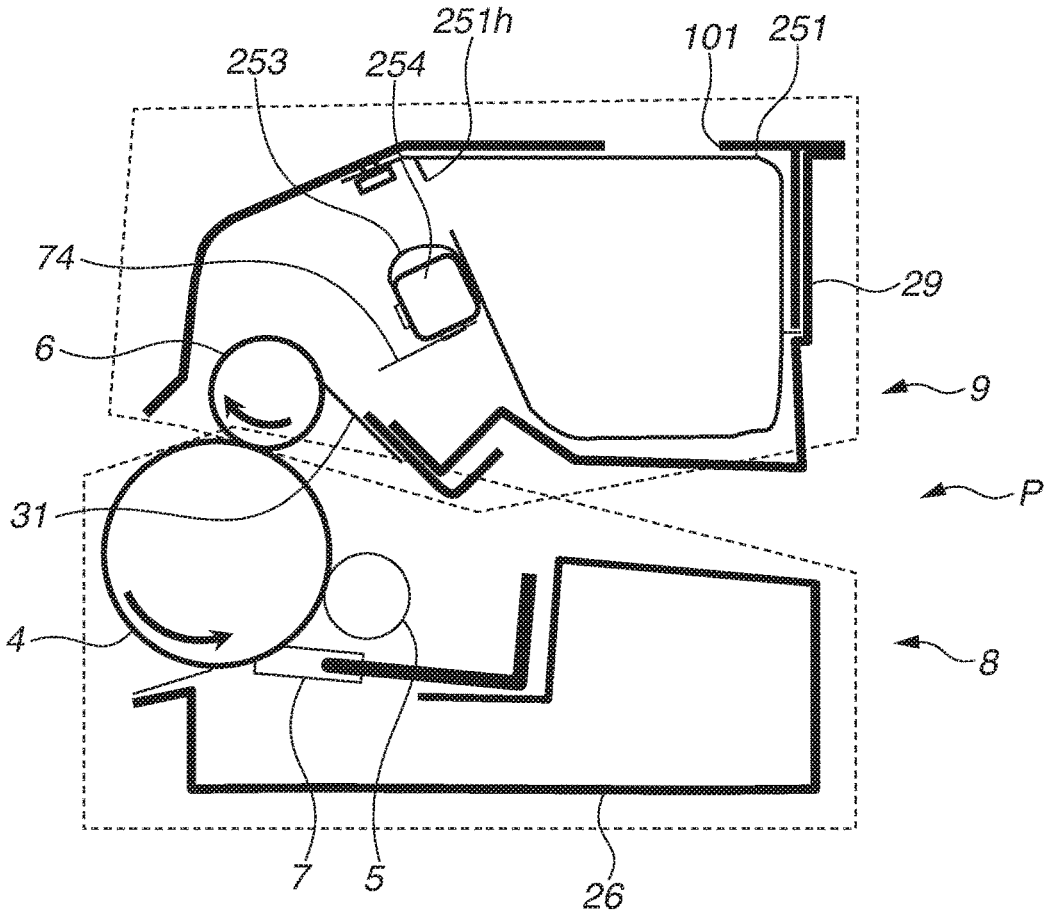
FIG. 6 is a sectional view of the cartridge illustrating a process for processing a first communication hole.

FIG. 6 is a sectional view of the cartridge P illustrating a process for processing a first communication hole 101. First of all, a process for processing the first communication hole 101 on the frame member 29 of the developing unit 9 will be described below with reference to FIG. 6. A user holds the cartridge P so that the developing unit 9 is disposed on the vertically upper side. Then, the user processes the first communication hole 101 as a "frame member communication hole" on the vertically upper surface of the frame member 29 (frame member processing process). The flexible container 251 fixed to the inside of the frame member 29 is thereby exposed through the first communication hole 101.

Second Communication Hole Processing Process

Figure 7:
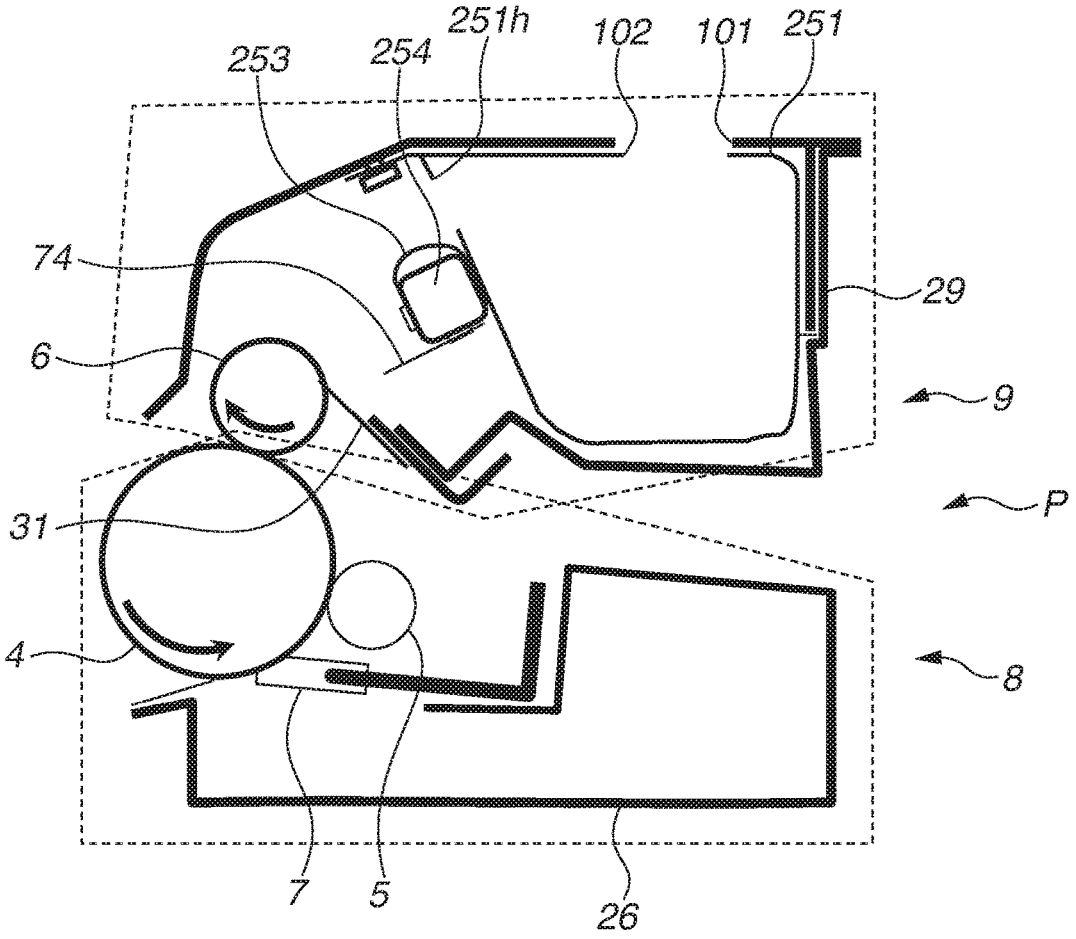
FIG. 7 is a sectional view of the cartridge illustrating a process for processing a second communication hole.

FIG. 7 is a sectional view of the cartridge P illustrating a process for processing a second communication hole 102. A process for processing the second communication hole 102 on the flexible container 251 fixed to the inside of the frame member 29 will be described below with reference to FIG. 7. Since the first communication hole 101 is processed, the flexible container 251 is exposed. The second communication hole 102 as a "container communication hole" is processed on the exposed flexible container 251 (container processing process). The outside of the cartridge P and the inside of the flexible container 251 are thereby communicated with each other, making it possible to refill the developer into the flexible container 251 through the first communication hole 101 and the second communication hole 102.

Figure 8A:
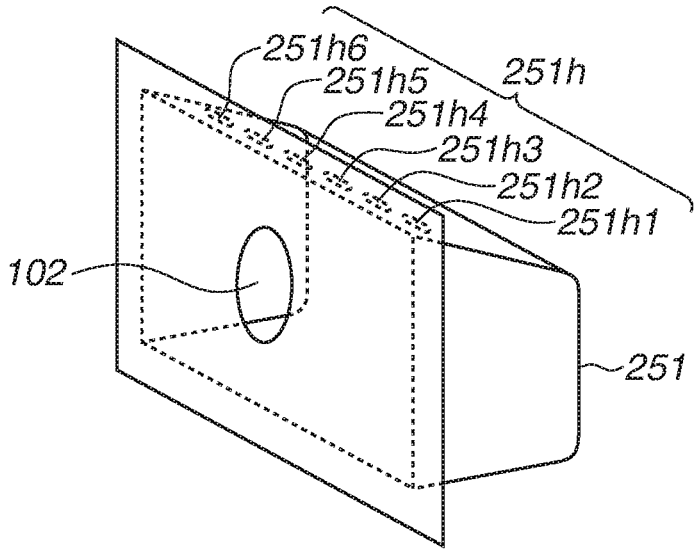
FIGS. 8A, 8B, and 8C are perspective views of a flexible container illustrating shapes of the second communication hole.
Figure 8B:
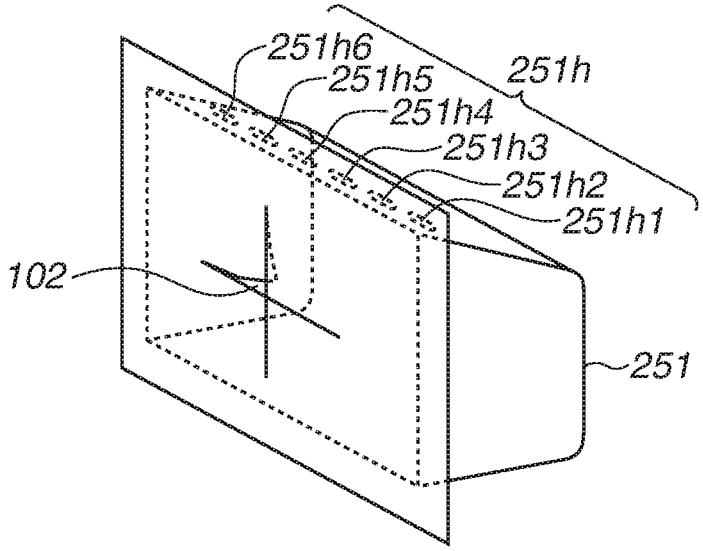
Figure 8C:
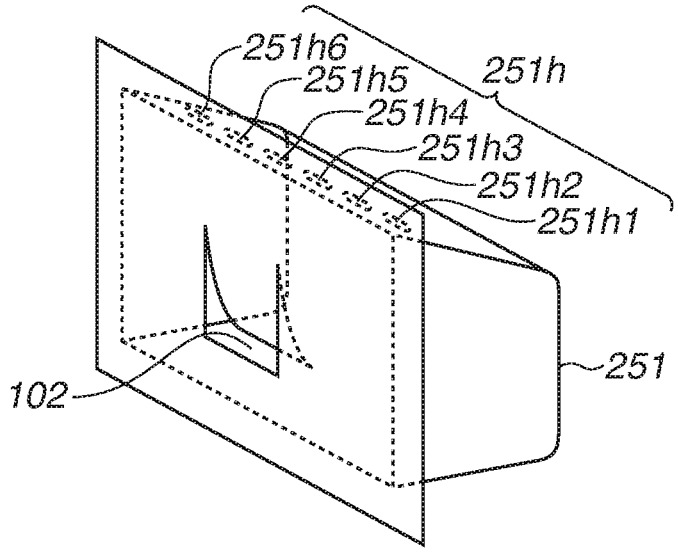

FIGS. 8A to 8C are perspective views of the flexible container 251 illustrating possible shapes of the second communication hole 102. As illustrated in FIGS. 8A to 8C, the second communication hole 102 may be a through hole such as a round hole (refer to FIG. 8A) and a square hole, or a cut portion such as a straight line cut portion, a cross-shaped cut portion (refer to FIG. 8B), and a U-shaped cut portion (refer to FIG. 8C). Further, the second communication hole 102 may have any shape as long as it enables communication between the inside of the frame member 29 and the inside of the flexible container 251, and a funnel 201 (described below) can be inserted therein. As the second communication hole 102, an opening larger than one of the openings 251*h* (251*h*1 to 251*h*6) of the flexible container 251 can be formed.

Developer Refilling Process

Figure 9:
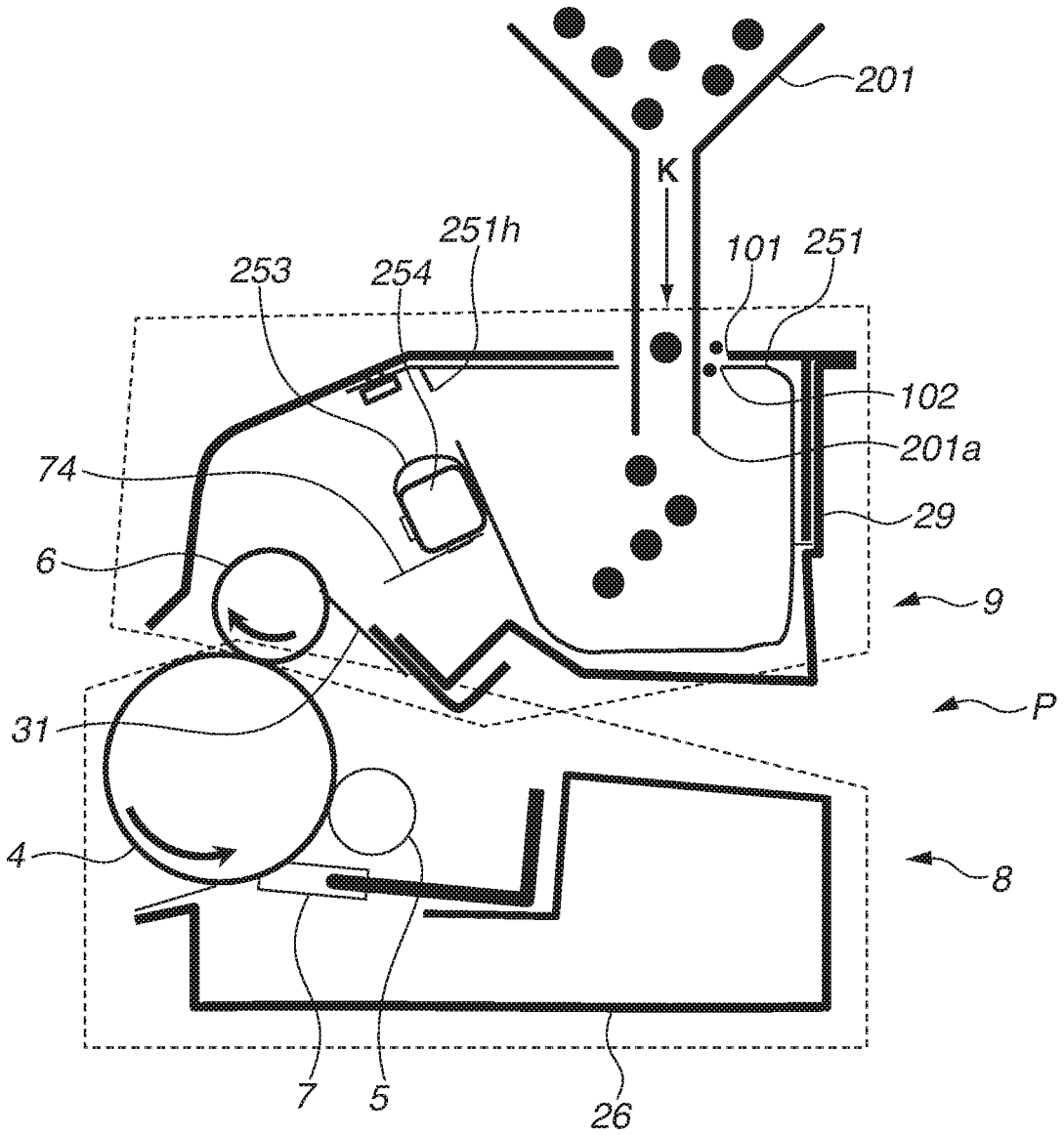
FIG. 9 is a sectional view illustrating a process for refilling developer into the cartridge through the first and the second communication holes.

FIG. 9 is a sectional view illustrating a process for refilling the developer into the cartridge P through the first communication hole 101 and the second communication hole 102. As illustrated in FIG. 9, the user refills the developer into the flexible container 251 inside the cartridge P in a state where the developing unit 9 is disposed on the vertically upper side. In this case, the user inserts the funnel 201 for refilling the developer, in the direction indicated by an arrow K illustrated in FIG. 9. A tip portion 201*a* of the funnel 201 is inserted into the flexible container 251 inside the frame member 29 from the outside of the frame member 29 through the first communication hole 101 and the second communication hole 102, and the developer is refilled into the flexible container 251 (refilling process).

The user pours the developer into the funnel 201 from, for example, a toner bottle (not illustrated) to refill the developer into the flexible container 251 inside the frame member 29. As described above, an opening larger than the openings 251*h* of the flexible container 251 can be formed as the second communication hole 102. Thus, when the developer is refilled into the flexible container 251 through the second communication hole 102, the funnel 201 having a larger cross-sectional area of the tip portion 201*a* can be used as compared to the case of refilling the developer into the flexible container 251 through the openings 251*h*. Therefore, the use of the second communication hole 102 enables more quick and efficient refilling of toner.

First Communication Hole Sealing Process

Figure 10:
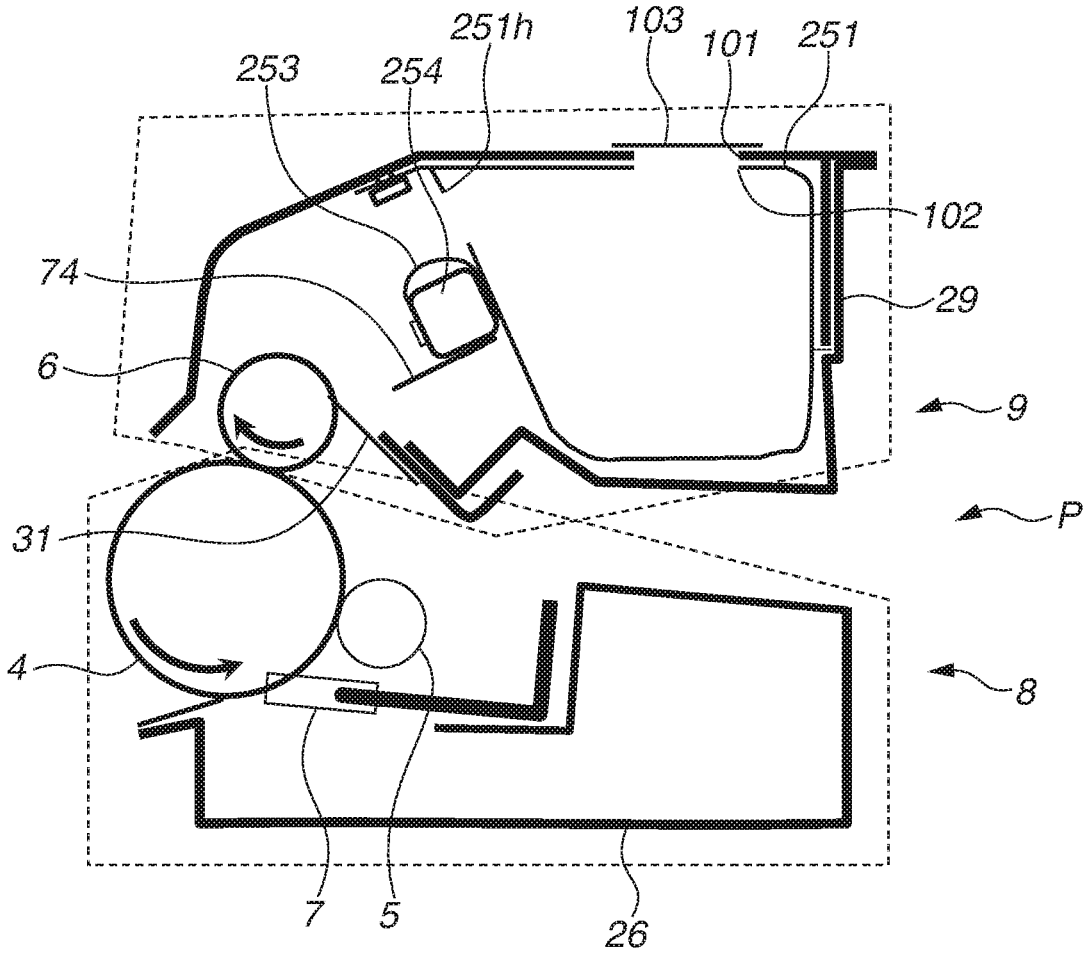
FIG. 10 is a sectional view of the cartridge illustrating a process for sealing the first communication hole.

FIG. 10 is a sectional view of the cartridge P illustrating a process for sealing the first communication hole 101. Then, the user attaches a first resealing member 103 for sealing the first communication hole 101, to the first communication hole 101 using a two-sided tape to prevent leakage of the developer from the frame member 29 (resealing process). As illustrated in FIG. 10, the first resealing member 103 is attached in a state where the cartridge P is held so that the developing unit 9 is disposed on the upper side. Then, the first resealing member 103 is attached to the frame member 29 so as to cover the first communication hole 101.

The first resealing member 103 may have any shape as long as it covers the first communication hole 101 to prevent leakage of the developer from the frame member 29. Further, the first resealing member 103 may be attached by using an adhesive instead of a two-sided tape. Further, the first resealing member 103 may not necessarily be a member to be attached using a two-sided tape or an adhesive, and may be a member to be fitted into the first communication hole 101, such as a cap. The above-described remanufacturing method of the cartridge P enables achievement of a simplified remanufacturing method of the cartridge P without disassembling the cartridge P.

Second Communication Hole Sealing Process (Optional)

Figure 11:
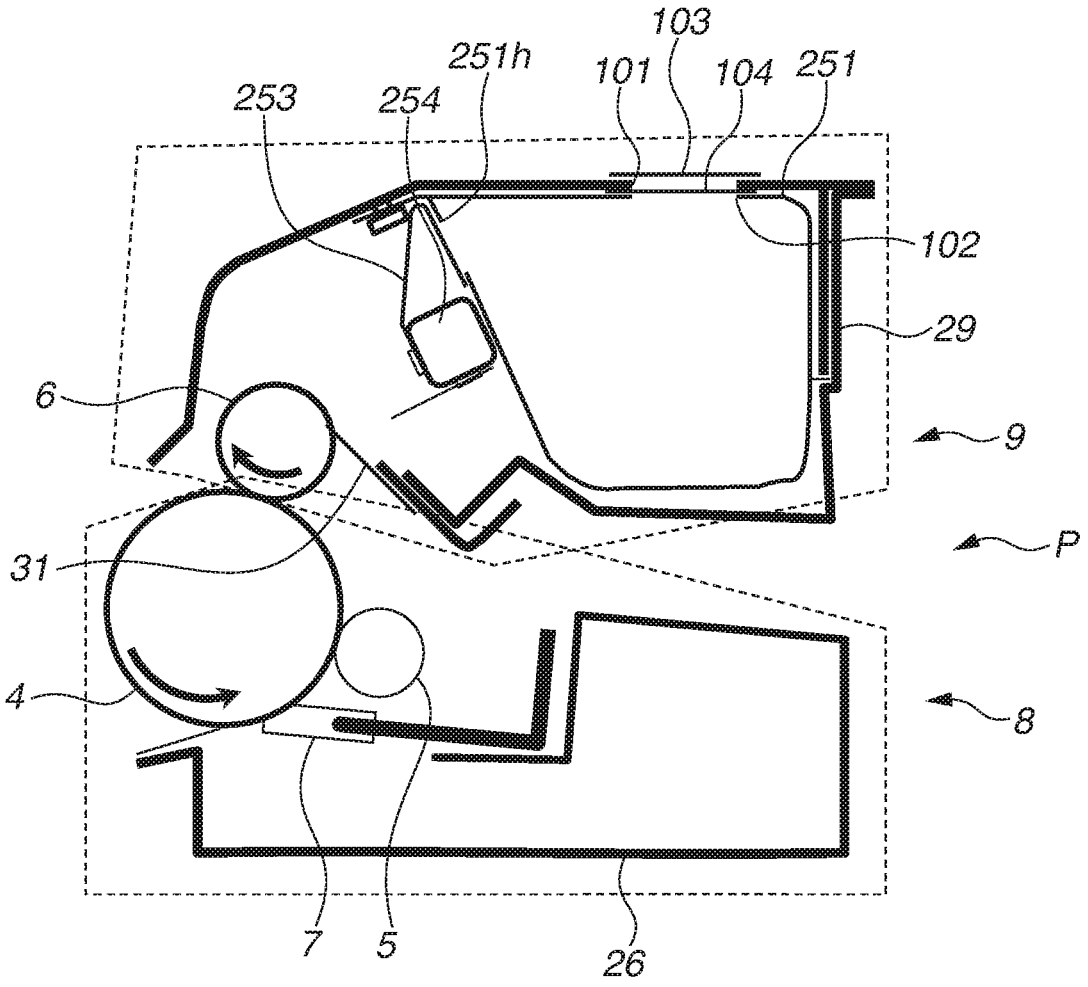
FIG. 11 is a sectional view of the cartridge illustrating a process for resealing the second communication hole.

FIG. 11 is a sectional view of the cartridge P illustrating a process for resealing the second communication hole 102. Similar to the first communication hole 101, the resealing process may be applied to the second communication hole 102. This process is performed for attaching a second resealing member 104 for sealing the second communication hole 102, to the second communication hole 102 using a two-sided tape to prevent leakage of the developer from the flexible container 251.

The second resealing member 104 is attached in a state where the developing unit 9 is oriented vertically upward. Then, the second resealing member 104 is attached to the flexible container 251 so as to cover the second communication hole 102. The second resealing member 104 may have any shape as long as it covers the second communication hole 102 to prevent leakage of the developer from the flexible container 251. Further, the second resealing member 104 may be attached by using an adhesive instead of a two-sided tape. Then, after performing the second communication hole sealing process for sealing the second communication hole 102, the user performs the first communication hole sealing process for sealing the first communication hole 101 as described above.

It is only required to seal at least either one of the above-described first communication hole 101 and the second communication hole 102 to seal the developer refilled in the flexible container 251 (communication hole sealing process). The above-described remanufacturing method of the cartridge P enables achievement of a simplified remanufacturing method of the cartridge P, in which toner is refilled only into the flexible container 251 to reduce the possibility of leakage of toner from the cartridge P.

Second Embodiment

In the first embodiment, the developer is refilled through the frame member 29 and the flexible container 251 without sealing the openings 251*h* of the flexible container 251. Alternatively, prior to toner refilling, the user may disassemble the cartridge P until the openings 251*h* are exposed, seal the openings 251*h* of the flexible container 251, and then reassemble the cartridge P. After these processes, toner may be refilled only into the flexible container 251.

Figure 12:
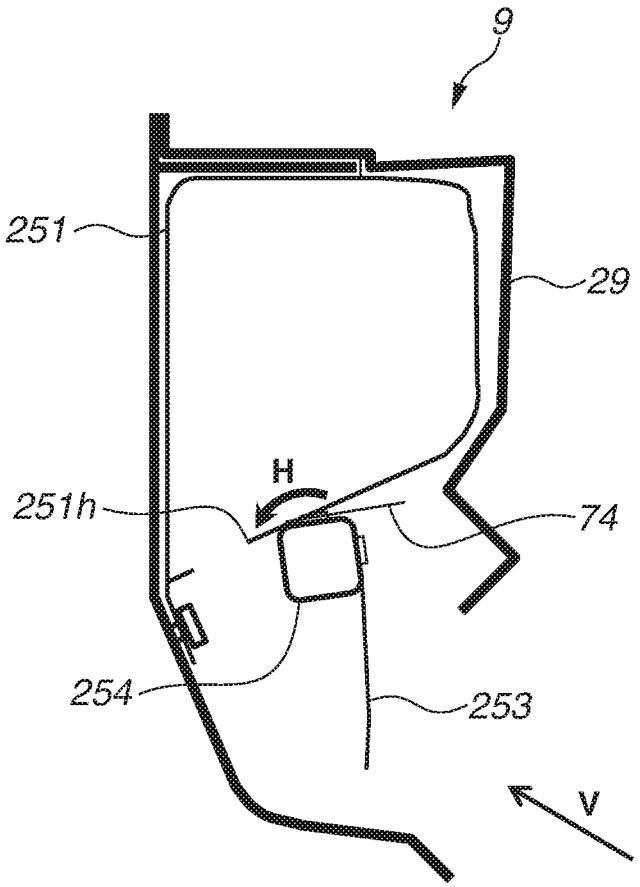
FIG. 12 is a sectional view of the cartridge illustrating a state before resealing by a sealing member.
Figure 13:
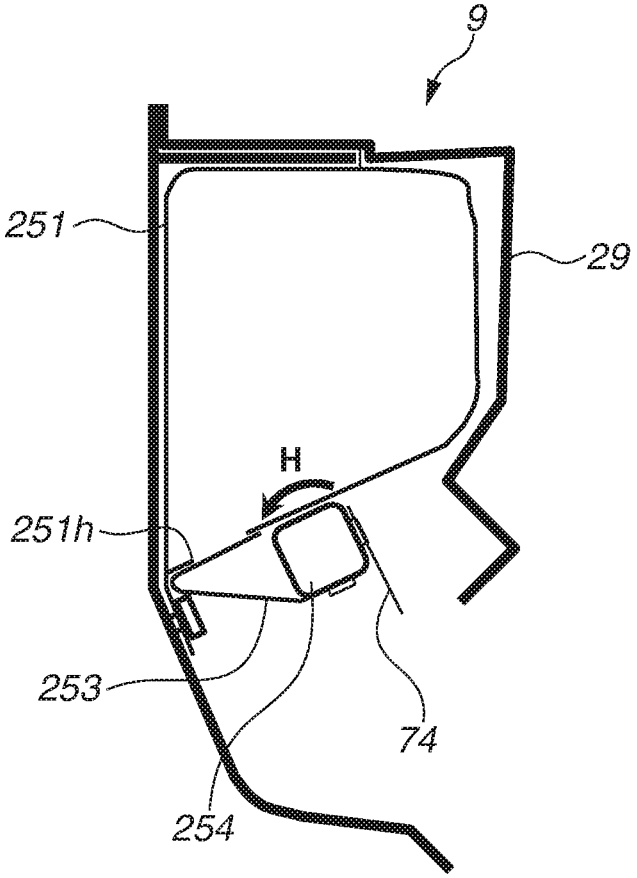
FIG. 13 is a sectional view of the cartridge illustrating a state after resealing by the sealing member.

FIG. 12 is a sectional view of the cartridge P illustrating a state before resealing by the sealing member 253. FIG. 13 is a sectional view of the cartridge P illustrating a state after resealing by the sealing member 253.

Unit Separation Process and Developing Unit Disassembling Process

In the above-described unit disassembling process, the user performs a separation process of the photosensitive unit 8 and the developing unit 9, and a disassembling process of the developing unit 9. Then, when the separation process of the developing unit 9 is completed, the openings 251*h* of the flexible container 251 inside the frame member 29 are exposed, allowing the user to refill the developer into the flexible container 251. However, the user does not refill the developer in this process. Then, the user seals the openings 251*h* of the flexible container 251 without refilling of the developer through openings 251*h*. This process will be described in detail below with reference to FIGS. 12 and 13.

Opening Resealing Process

As illustrated in FIG. 12, in the above-described separation process, the sealing member 253 is detached and the openings 251*h* are exposed. In this state, the sealing member 253 is accessed from the direction indicated by an arrow V illustrated in FIG. 12, the sealing member 253 once used for sealing is welded to the flexible container 251 again, and the sealing member 253 is attached to the openings 251*h* of the flexible container 251 to reseal the openings 251*h*.

This results in the resealed state illustrated in FIG. 13. The leakage of toner from the flexible container 251 can be thereby prevented, and toner can be refilled only into the flexible container 251. The openings 251*h* are not necessarily sealed by welding, and may be sealed by adhesion by using a two-sided tape. After performing the opening resealing processes, the cartridge P is reassembled.

Developing Unit Assembling Process and Unit Combining Process

More specifically, the user performs an assembling process of the developing unit 9 and an assembling process of the photosensitive unit 8 and the developing unit 9.

After completion of the assembling process of the cartridge P, the user performs the first communication hole processing process, the second communication hole processing process, and the toner refilling process which are similar to the processes according to the above-described embodiment. The above-described remanufacturing method of the cartridge P enables achievement of a simplified remanufacturing method of the cartridge P.

Third Embodiment

Developer Refilling Process

Figure 15A:
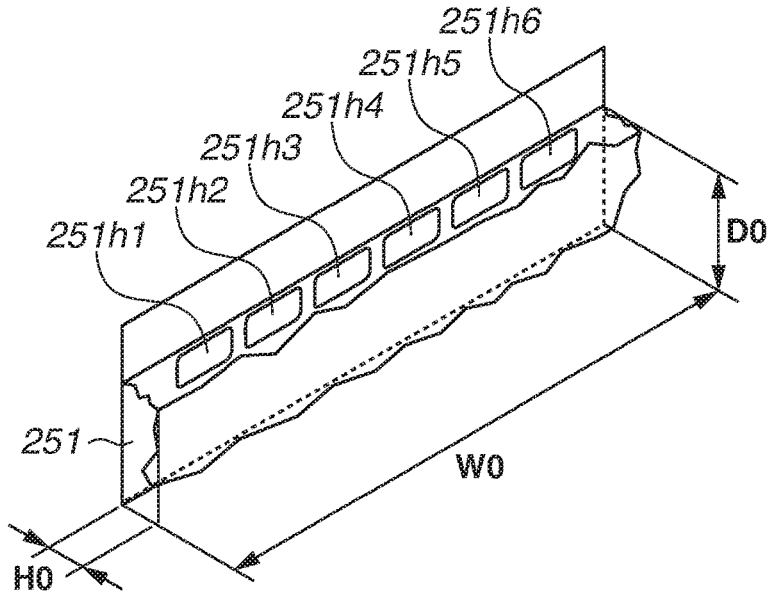
FIG. 15A is a perspective view illustrating a state of the flexible container containing no developer, before the developer is refilled.
Figure 15B:
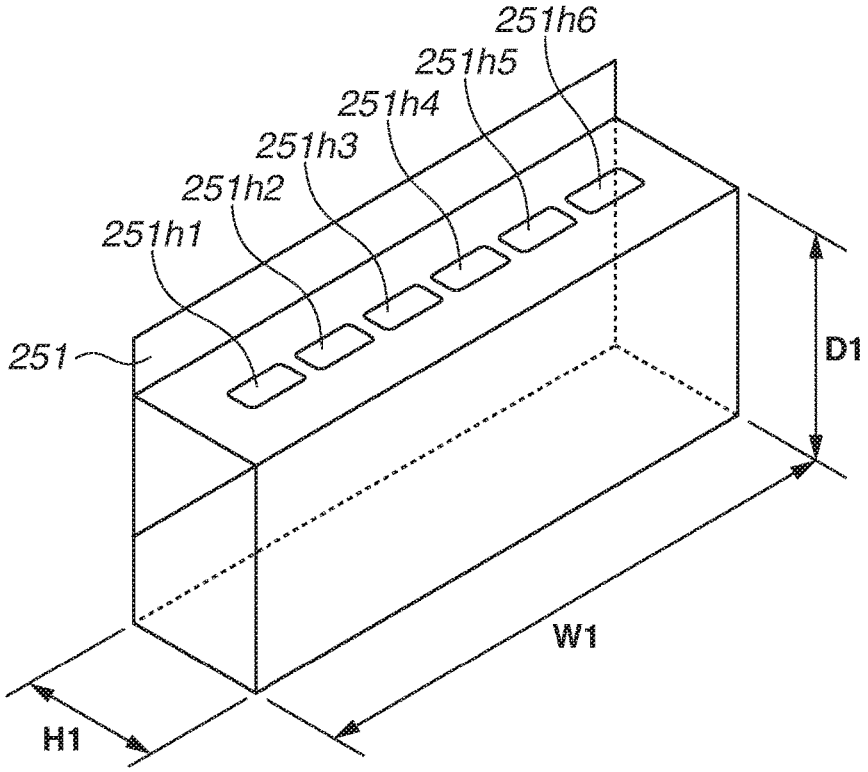
FIG. 15B is a perspective view illustrating a state of a new flexible container.

FIG. 15A is a perspective view illustrating a state of the flexible container 251 containing no developer, before refilling of the developer. FIG. 15B is a perspective view illustrating a state of the new flexible container 251. As illustrated in FIGS. 15A and 15B, the flexible container 251 before refilling of the developer has a different shape from that of the new flexible container 251, and has a smaller capacity than that of the new flexible container 251. The user holds the frame member 29 so that the openings 251*h* (251*h*1 to 251*h*6) of the flexible container 251 are oriented vertically upward, and refills the developer.

More specifically, when the size of the flexible container 251 before remanufacturing is represented by H0 in height, D0 in depth, and W0 in width, and the size of the new flexible container 251 is represented by H1 in height, D1 in depth, and W1 in width, a relationship "W1<W0, D1<D0, and H1<H0" may be satisfied. To refill more developer into the flexible container 251, it is desirable to make the capacity of the flexible container 251 approximately equivalent to that of the new flexible container 251. Therefore, for example, before refilling the developer, the user may inject compressed air into the flexible container 251 to increase the capacity of the flexible container 251.

Figure 17:
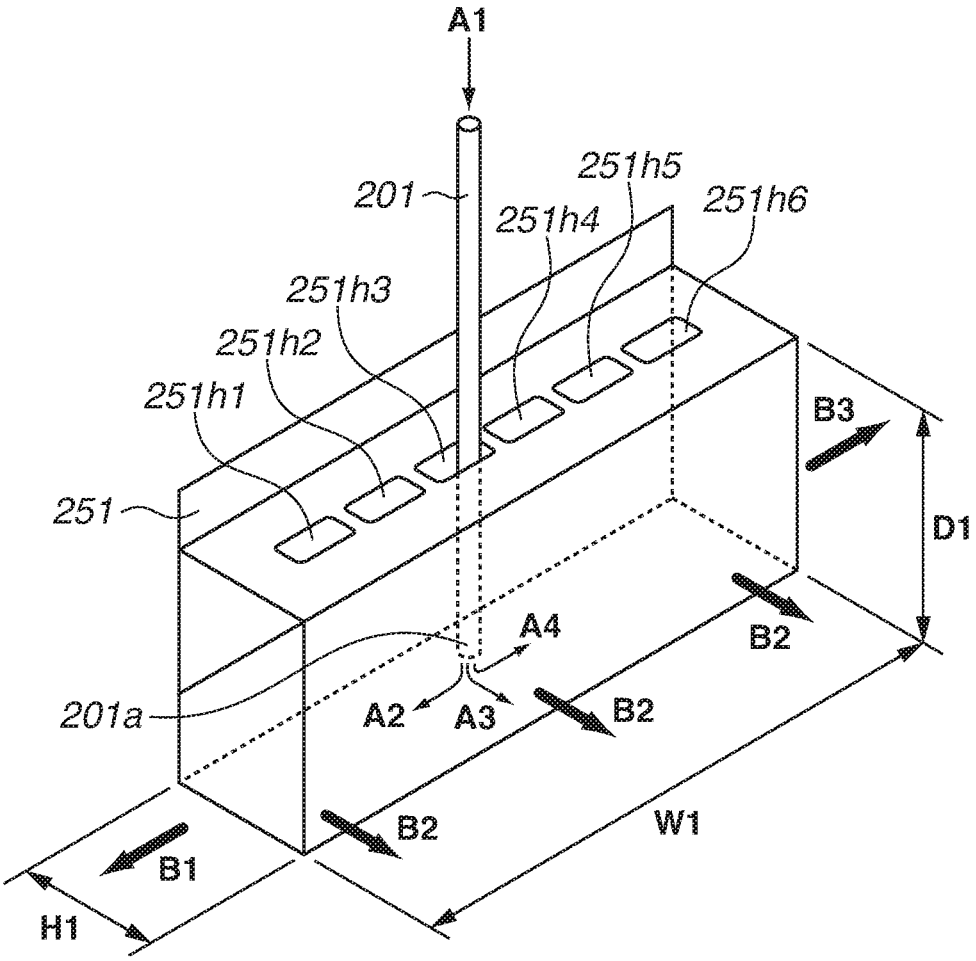
FIG. 17 is a perspective view illustrating a process for injecting compressed air into the flexible container to increase a capacity of the flexible container.

FIG. 17 is a perspective view illustrating a process for injecting compressed air into the flexible container 251 to increase the capacity of the flexible container 251. The tip portion 201*a* of the funnel 201 is inserted into the flexible container 251 through the openings 251*h* (251*h*1 to 251*h*6) of the flexible container 251. When the flexible container 251 is provided with a plurality of openings 251*h*, the tip portion 201*a* of the funnel 201 may be inserted into any one of the openings 251*h*1 to 251*h*6.

When compressed air is injected into the flexible container 251 from the funnel 201 in the direction indicated by an arrow A1 as illustrated in FIG. 17, compressed air is injected into the flexible container 251 from the tip portion 201*a* of the funnel 201 in the directions indicated by arrows A2 to A4 (air injection process). Then, the flexible container 251 inflates in the directions indicated by arrows B1 to B3, and accordingly the size (the height H1, the depth D1, and the width W1) of the flexible container 251 recovers to almost the same size as the new flexible container 251.

Figure 18:
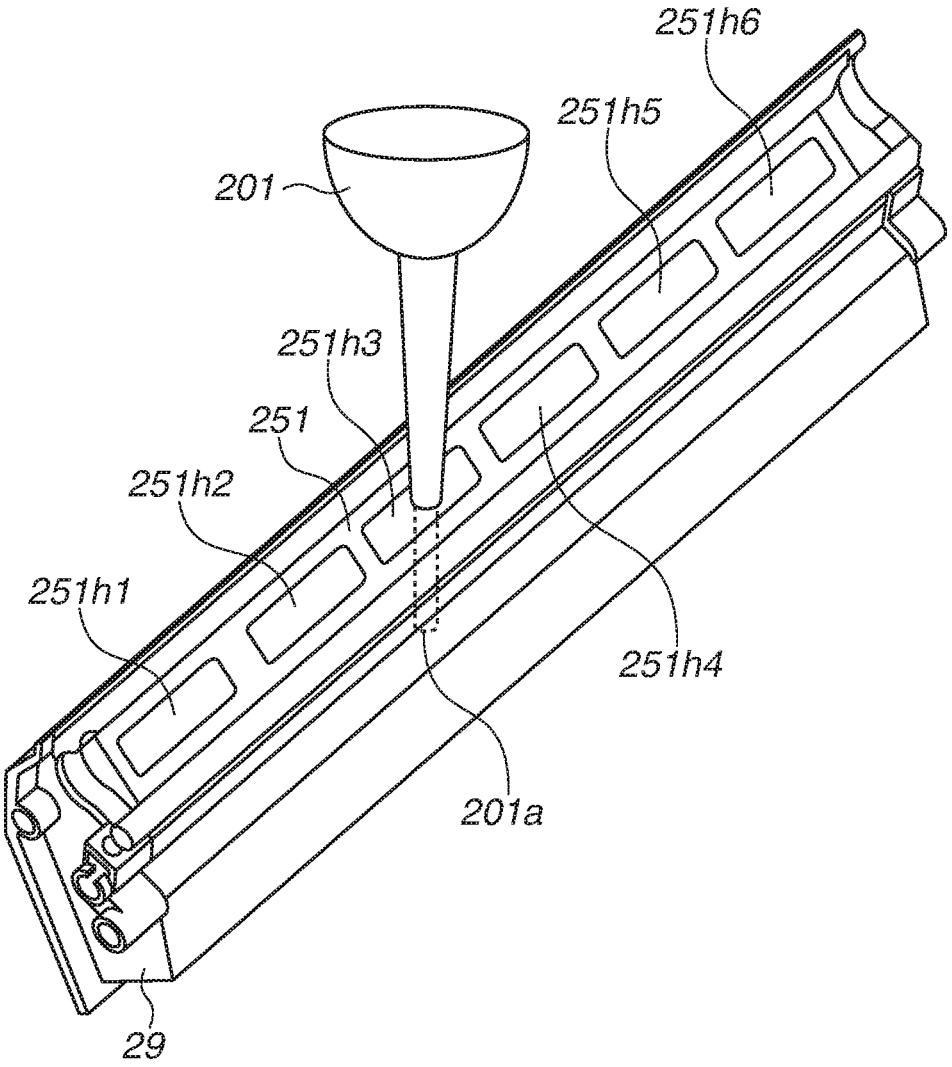
FIG. 18 is a perspective view illustrating a process for refilling the developer into a frame member through an opening of the flexible container, using a funnel.
Figure 20:
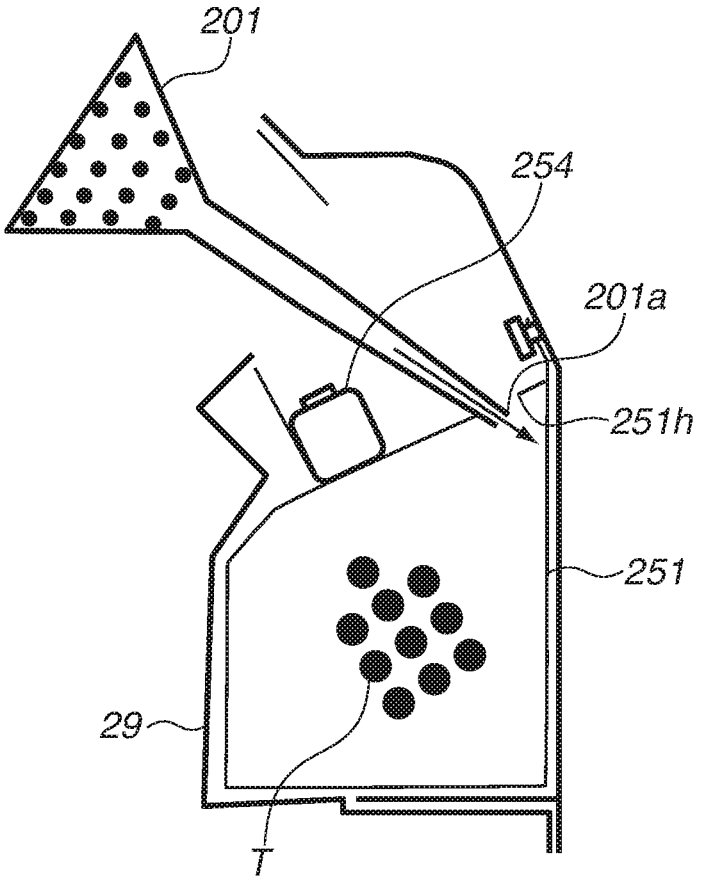
FIG. 20 is a sectional view illustrating a process for refilling the developer through an opening of the flexible container, using a funnel.

FIG. 18 is a perspective view illustrating a process for refilling the developer into the frame member 29 through the openings 251*h* of the flexible container 251, using the funnel 201. FIG. 20 is a sectional view illustrating a process for refilling the developer through the openings 251*h* (251*h*1 to 251*h*6) of the flexible container 251, using the funnel 201.

The tip portion 201*a* of the funnel 201 is inserted through the openings 251*h* (251*h*1 to 251*h*6) of the flexible container 251. The user refills the developer into the flexible container 251 by dropping the developer into the funnel 201 from a developer bottle (not illustrated). In addition, using a fixed-rate feeding device having an auger in the funnel-shaped main body enables efficient refilling of the developer. When the flexible container 251 is provided with a plurality of openings 251*h*, the tip portion 201*a* of the funnel 201 may be inserted into any one of the openings 251*h*1 to 251*h*6.

Developing Unit Assembling Process and Unit Combining Process

When the refilling of the developer is completed, the user performs the assembling process of the developing unit 9 and the combining process of the photosensitive unit 8 and the developing unit 9. Upon completion of the above-described procedure, the assembling process of the cartridge P is completed as illustrated in FIG. 3. The above-described remanufacturing method of the cartridge P enables achievement of a simplified remanufacturing method of the cartridge P.

Fourth Embodiment

Figure 21:
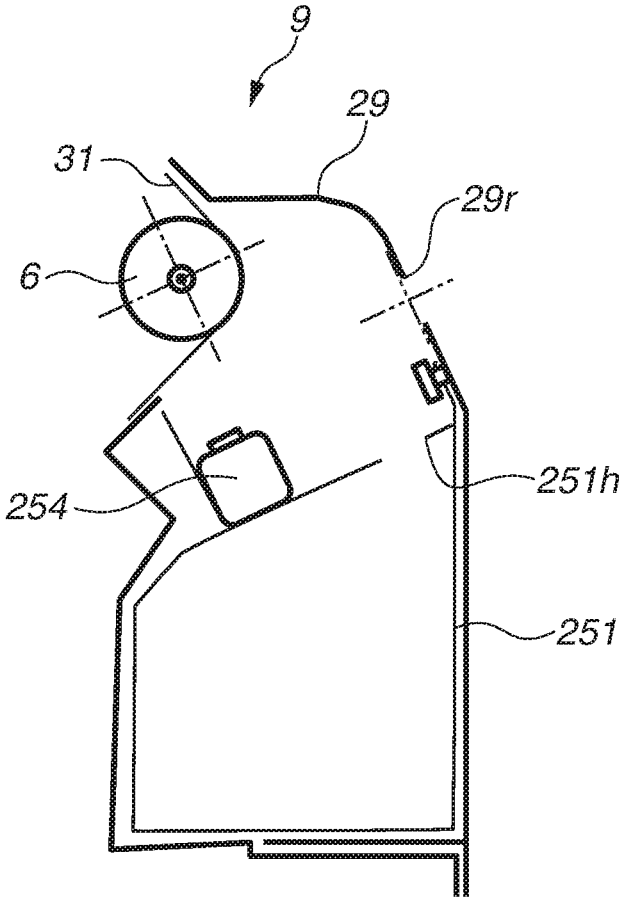
FIG. 21 is a sectional view illustrating a developing unit.

FIG. 21 is a sectional view illustrating the developing unit 9. In the fourth embodiment, similar to the third embodiment, the user performs a developer refilling process without removing the developing roller 6 and the developing blade 31. Similar to the above descriptions, the user performs a unit separation process and a developing unit separation process to make the developing unit 9 a single unit. As illustrated in FIG. 21, the user processes, on the frame member 29, a filling port 29*r* as a "frame member communication hole" as a hole for refilling the developer (frame member processing process). The filling port 29*r* may have any shape as long as the tip portion 201*a* of the funnel 201 (described below) can be inserted therein.

Figure 22:
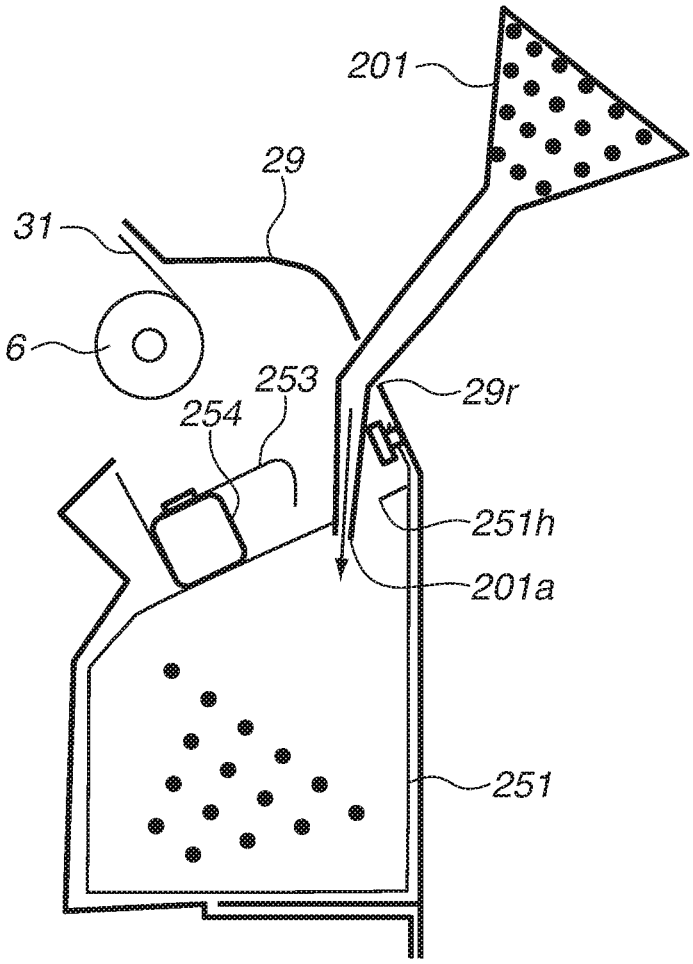
FIG. 22 is a sectional view illustrating a process for refilling the developer into the flexible container inside the developing unit.

FIG. 22 is a sectional view illustrating a process for refilling the developer into the flexible container 251 inside the developing unit 9. As illustrated in FIG. 22, the user inserts the tip portion 201*a* of the funnel 201 into the flexible container 251 inside the frame member 29 through the filling port 29*r* of the frame member 29 and the openings 251*h* of the flexible container 251, and then refills the developer.

Figure 23:
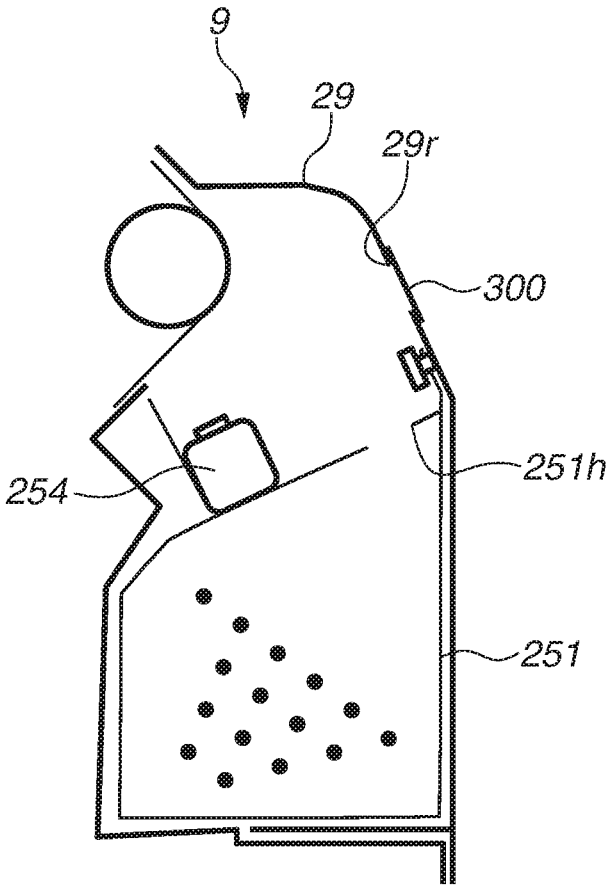
FIG. 23 is a sectional view of the developing unit illustrating a state where the developer is refilled.

FIG. 23 is a sectional view of the developing unit 9 illustrating a state where the developer is refilled. As illustrated in FIG. 23, the filling port 29*r* of the frame member 29 is sealed by a hole sealing member 300. As the hole sealing member 300, an adhesive tape, a plastic plate with an adhesion layer, etc. can be desirably used. In the subsequent processes, the user combines the unit in reverse order of the unit separation process to complete the assembling process.

Fifth Embodiment

Sealing Member Removing Process

Figure 24:
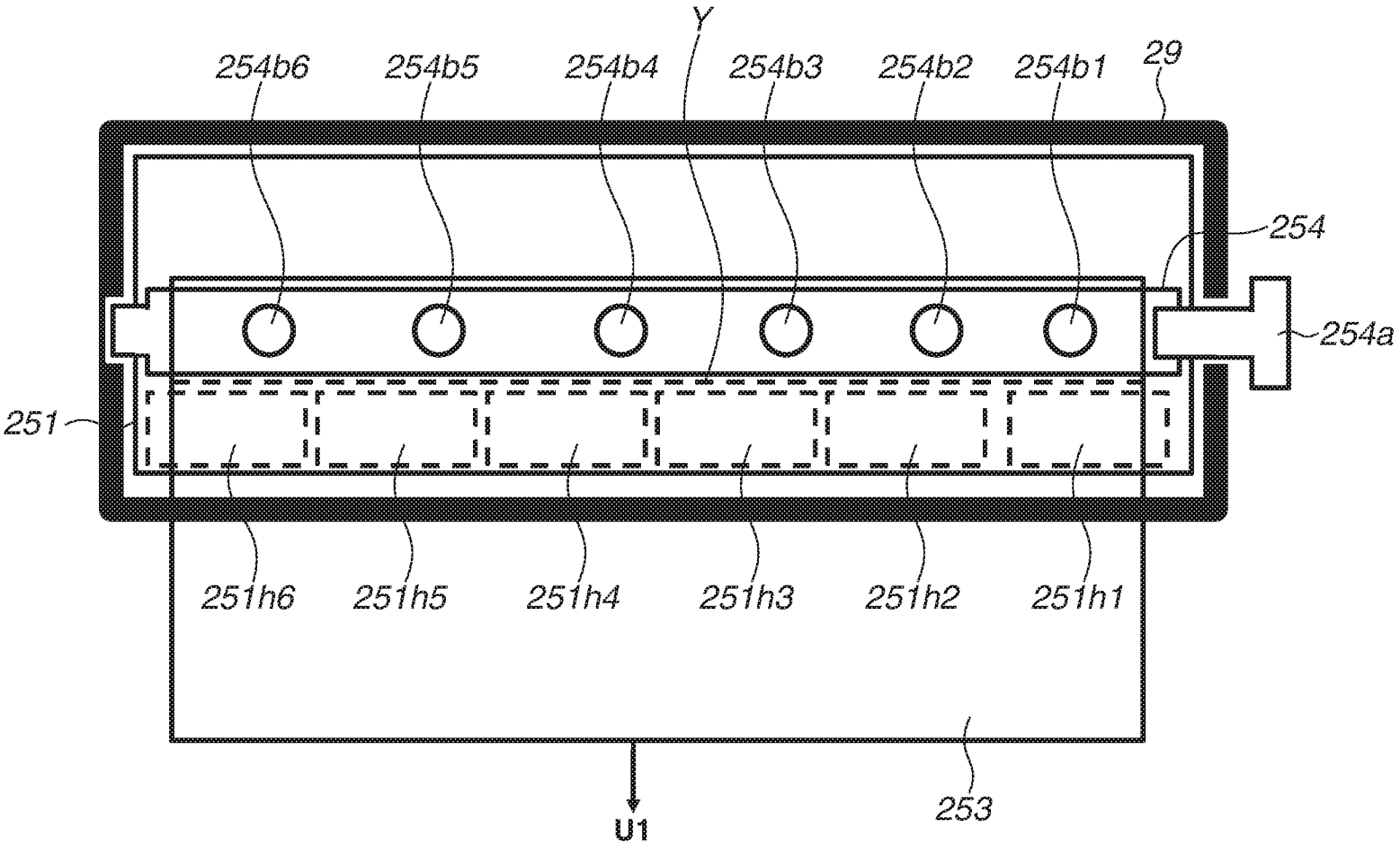
FIG. 24 is a front view illustrating the frame member viewed from an opening side of the flexible container.

FIG. 24 is a front view illustrating the frame member 29 viewed from the side of the openings 251*h* of the flexible container 251. The sealing member 253 is fixed at fixing portions 254*b* (254*b*1 to 254*b*6) of the unsealing member 254 through ultrasonic welding. On the drive side of the unsealing member 254, a gear 254*a* is fitted into the unsealing member 254. The non-drive side of the unsealing member 254 is held by the frame member 29.

After the flexible container 251 is unsealed, the sealing member 253 is wound around the unsealing member 254. The user is able to remove the sealing member 253 by pulling the sealing member 253 wound around the unsealing member 254 in the direction indicated by an arrow U1 and then cutting off a dashed line portion Y of the sealing member 253 with a cutter. The remanufacturing method includes a removing process for removing at least a part of the sealing member 253 in this way before the refilling process. The user may remove the sealing member 253 from the unsealing member 254 by pulling the sealing member 253 wound around the unsealing member 254 in the direction indicated by the arrow U1.

As a shape to make it easy to remove the sealing member 253, for example, the thickness of the sheet of the sealing member 253 in the vicinity of the fixing portions 254*b* of the unsealing member 254 may be thinner than a portion welded in the vicinity of the openings 251*h*. In other words, in the sealing member 253, the film thickness of the portion to which the unsealing member 254 is fixed is thinner than that of the portion at which the openings 251*h* of the flexible container 251 are sealed. The force required to separate the sealing member 253 from the fixing portions 254*b* of the unsealing member 254 is only required to be larger than the force required to detach the sealing member 253 from the flexible container 251.

Upon completion of the above-described procedure, the disassembling process of the developing unit 9 is completed. Then, the openings 251*h* (251*h*1 to 251*h*6) of the flexible container 251 provided in the frame member 29 are exposed, allowing the developer to be refilled into the flexible container 251. In the assembling process after refilling the developer, it is not necessary to reattach the removed sealing member 253.

Effects of Sealing Member Removing Process

Removing at least a part of the sealing member 253 from the unsealing member 254 can enhance the efficiency of the refilling process for refilling the developer through the openings 251*h* inside the flexible container 251.

Developer Refilling Process

Then, the user performs a developer refilling process. This process is similar to the above-described methods illustrated in FIGS. 6 to 11.

Developing Unit Assembling Process and Unit Assembling Process

When the refilling of the developer is completed, the user performs the assembling process of the developing unit 9 and the assembling process of the photosensitive unit 8 and the developing unit 9. Upon completion of the above-described procedure, the assembling process of the cartridge P is completed as illustrated in FIG. 3. The above-described remanufacturing method of the cartridge P enables achievement of a simplified remanufacturing method of the cartridge P.

Sixth Embodiment

Figure 25:
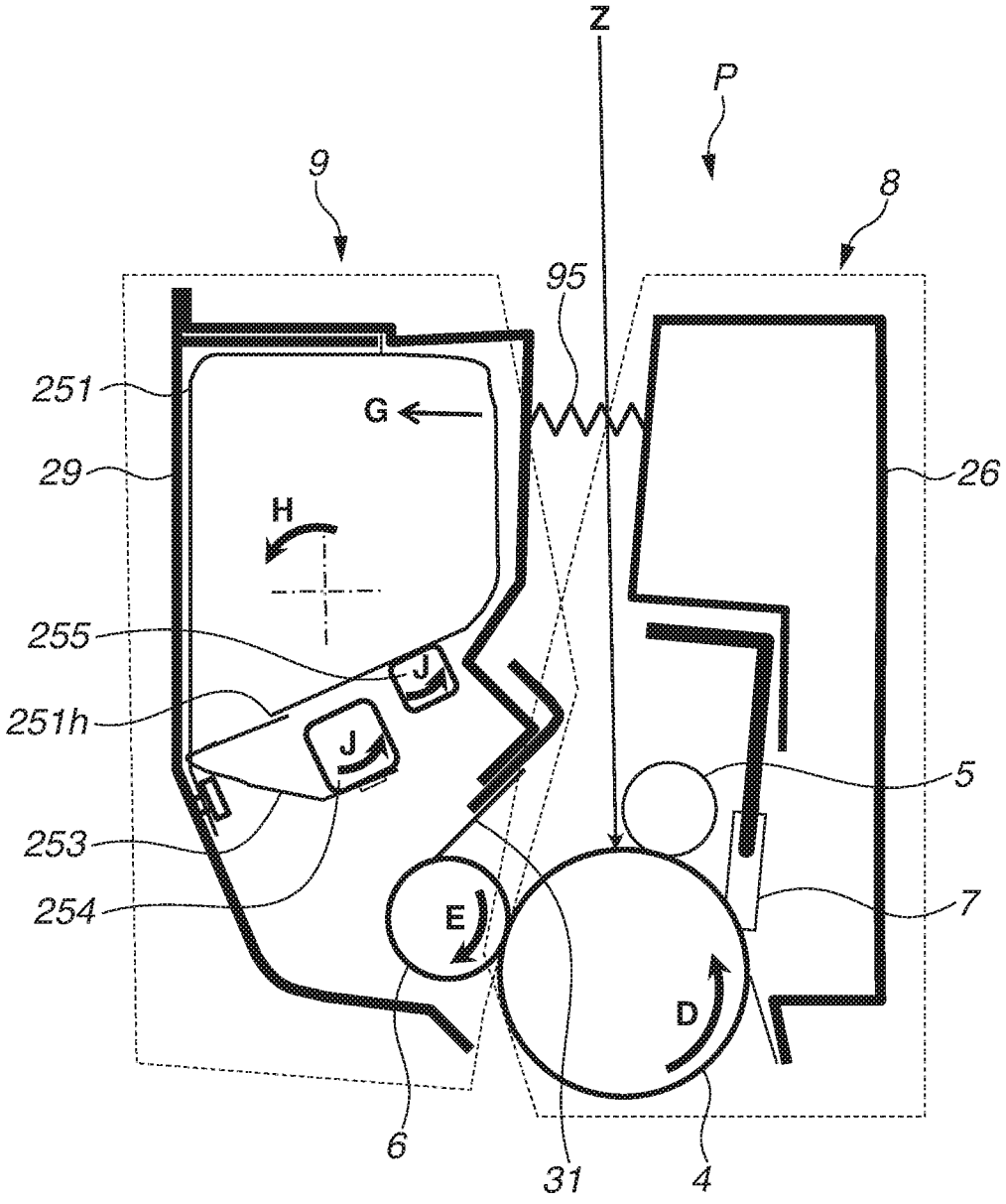
FIG. 25 is a sectional view illustrating the cartridge in which the developing unit includes an unsealing member and a pressing member.

In the fifth embodiment, the unsealing member 254 has a function of a pressing member. In the sixth embodiment, the description will be given of a case in which the function of the unsealing member 254 is separated from the function of a pressing member. FIG. 25 is a sectional view illustrating the cartridge P in which the developing unit 9 includes the unsealing member 254 and a pressing member 255. As illustrated in FIG. 25, the pressing member 255 and the unsealing member 254 are configured to receive a driving force from the apparatus body 2 to be rotatable in the direction indicated by the arrow J.

Figure 26:
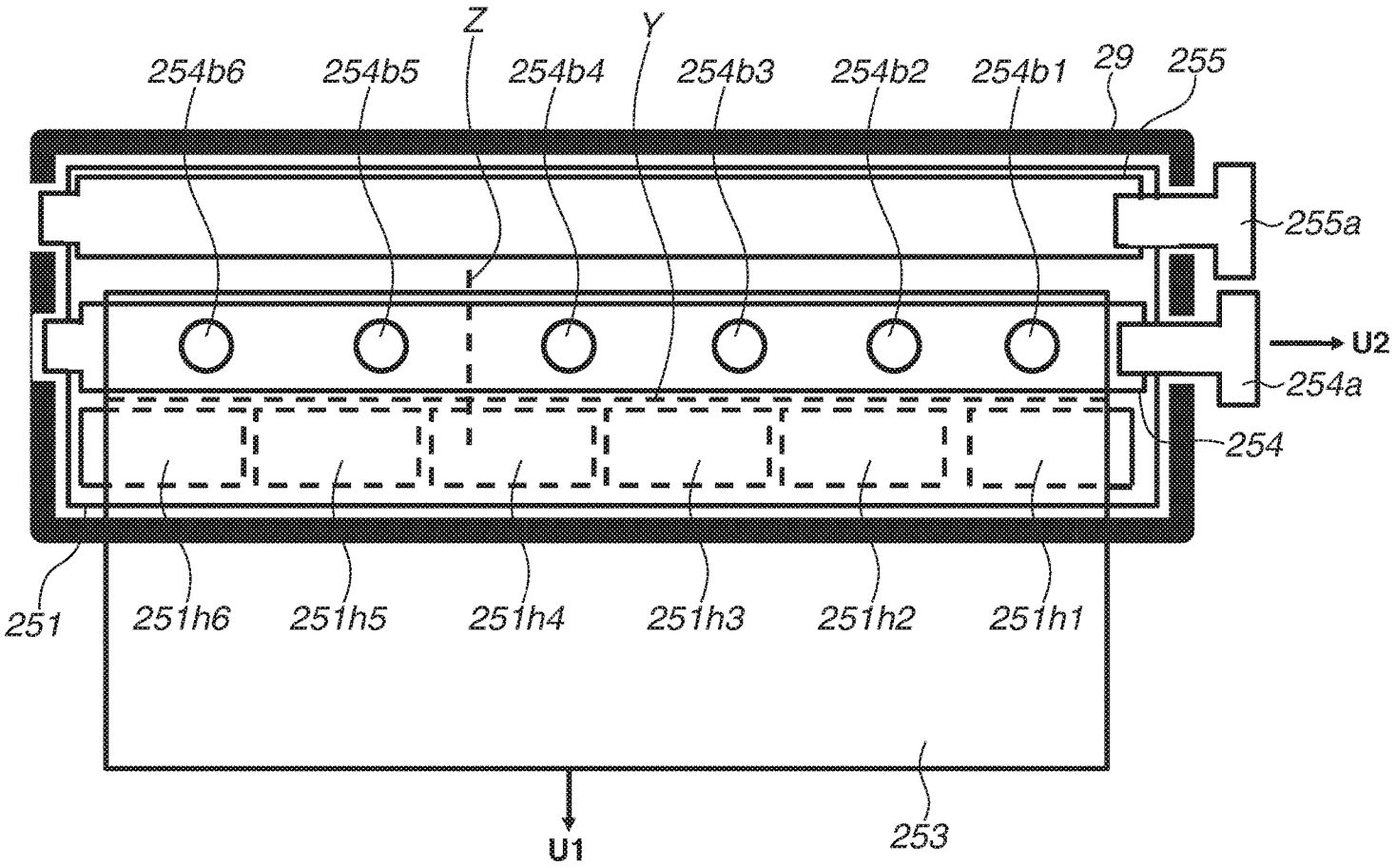
FIG. 26 is a front view illustrating the frame member of the cartridge in which the developing unit includes the unsealing member and the pressing member, viewed from an opening side of the flexible container.

FIG. 26 is a front view illustrating the frame member 29 of the cartridge P in which the developing unit 9 includes the unsealing member 254 and the pressing member 255, viewed from the side of the openings 251*h* of the flexible container 251. The sealing member 253 is fixed at the fixing portions 254*b*(254*b*1 to 254*b*6) of the unsealing member 254 through ultrasonic welding. On the drive side of the unsealing member 254, the gear 254*a* is fitted into the unsealing member 254. The non-drive side of the unsealing member 254 is held by the frame member 29.

Similar to the unsealing member 254, on the drive side of the pressing member 255, a gear 255*a* of the pressing member 255 is fitted into the pressing member 255. The pressing member 255 moves the flexible container 251 to promote the discharge of the developer. In the remanufactured process cartridge, since an operation for unsealing the flexible container 251 is not required, not only the sealing member 253 but also the unsealing member 254 can be removed as described below.

Sealing Member and Unsealing Member Removing Process

The unsealing member 254 and the gear 254*a* can be separated from each other by pulling the gear 254*a* in the direction indicated by an arrow U2. Then, the user pulls out the non-drive side of the unsealing member 254 held by the frame member 29. The sealing member 253 and the unsealing member 254 can be thereby separated from the frame member 29.

The user may bend the unsealing member 254 to detach the non-drive side from the frame member 29, and then pull out the gear 254*a* in the direction indicated by the arrow U2. Alternatively, for example, the user may cut off the sealing member 253 and the unsealing member 254 at a dashed line portion Z using a nipper, and then remove the non-drive side of the unsealing member 254 from the frame member 29 to separate the unsealing member 254 and the gear 254*a*.

The user may separately remove the sealing member 253 and the unsealing member 254. More specifically, the user may pull the sealing member 253 in the direction indicated by the arrow U1 as in the fifth embodiment to remove the sealing member 253, and then remove the unsealing member 254 from the frame member 29 as described above.

Figure 27:
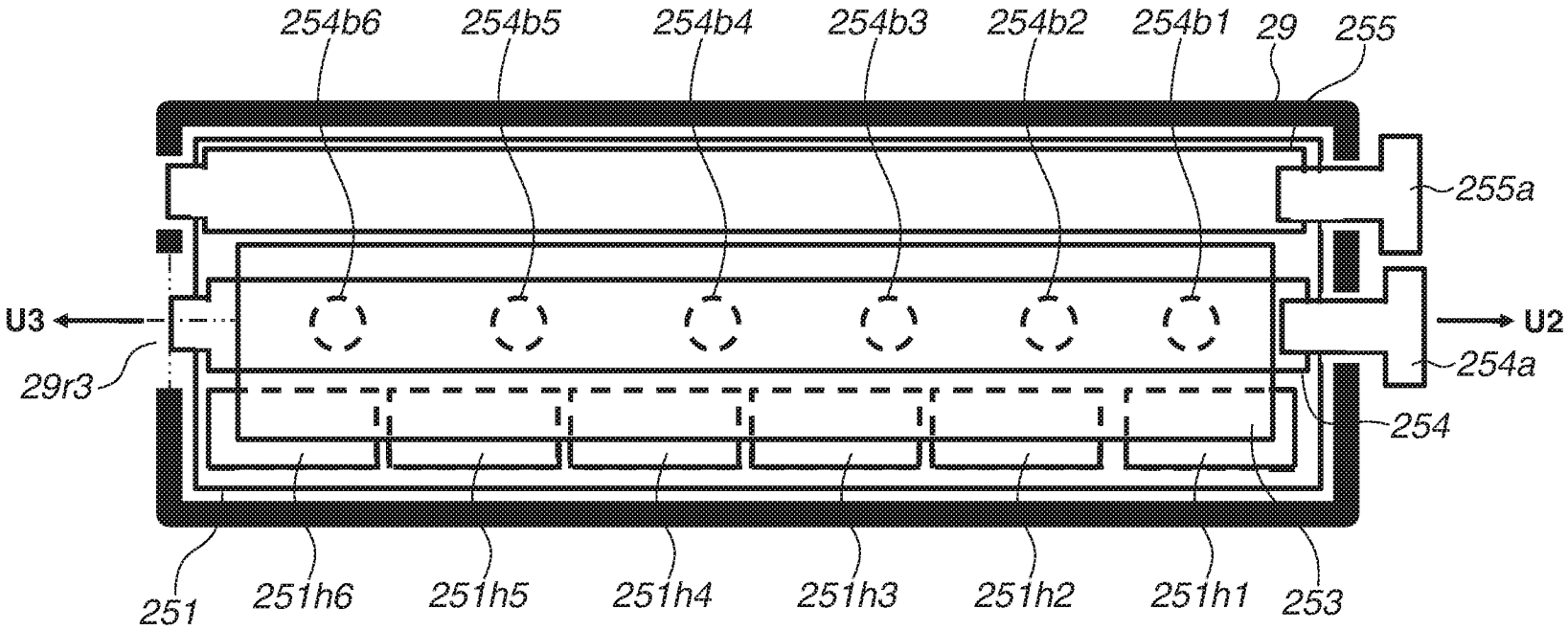
FIG. 27 is a front view illustrating the frame member of the cartridge in which the developing unit includes the unsealing member and the pressing member, viewed from an opening side of the flexible container.

Alternatively, as illustrated in FIG. 27, a hole 29*r*3 for removing the sealing member 253 and the unsealing member 254 may be formed on the non-drive side surface of the frame member 29 holding the sealing member 253 and the unsealing member 254.

The hole 29*r*3 is only required to have a size such that the sealing member 253 and the unsealing member 254 can be pulled out therethrough. The user pulls out the unsealing member 254 in the direction indicated by an arrow U3 while holding the gear 254*a*. Then, the user pulls out the gear 254*a* in the direction indicated by the arrow U2. Alternatively, while holding the unsealing member 254 through the hole 29*r*3, the user may first pull out the gear 254*a* in the direction indicated by the arrow U2, and then pull out the unsealing member 254 in the direction indicated by the arrow U3 through the hole 29*r*3.

To seal the hole 29*r*3 and the hole from which the gear 254*a* was pulled out, the user can desirably use an adhesive tape, a plastic plate with an adhesion layer, etc. In the assembling process after refilling the developer, it is not necessary to reattach the sealing member 253, the unsealing member 254, and the gear 254*a* that have been removed.

Seventh Embodiment

In the fifth embodiment, the detailed description has been given of a case in which a hole for removing the sealing member 253 is not processed on the sealing member 253. In the seventh embodiment, a case in which a perforation is formed at the dashed line portion Y illustrated in FIG. 24, and the sealing member 253 has a perforation is described.

Sealing Member Removing Process

As illustrated in FIG. 24, the user pulls the sealing member 253 in the direction indicated by the arrow U1 to release it from the state of being wound around the unsealing member 254. Then, the user pulls the sealing member 253 so as to cut off the perforation. The sealing member 253 can be thereby cut off.

The force required to separate the sealing member 253 at the perforation of the sealing member 253 is only required to be larger than the force required to detach the sealing member 253 from the flexible container 251. Further, the force required to separate the sealing member 253 from the fixing portions 254*b* of the unsealing member 254 is only required to be larger than the force required to separate the sealing member 253 at the perforation of the sealing member 253. In the assembling process after refilling the developer, it is not necessary to reattach the removed sealing member 253.

Eighth Embodiment

Figure 28:
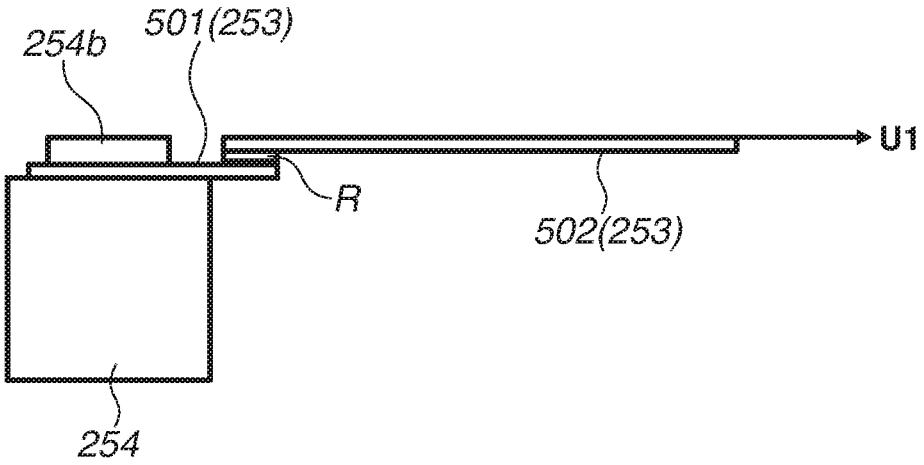
FIG. 28 is a side view illustrating the sealing member and the unsealing member.

In the first embodiment, the detailed description has been given of a case in which the sealing member 253 is formed of one sheet. In the eighth embodiment, the description will be given of a case in which the sealing member 253 is formed by a fixing member 501 and an opening sealing member 502. As illustrated in FIG. 28, the fixing member 501 is fixed to the fixing portions 254*b* of the unsealing member 254. The opening sealing member 502 is a member for sealing the openings 251*h* of the flexible container 251. The fixing member 501 as a "fixing portion" and the opening sealing member 502 as a "sealing portion" are detachably adhered to each other at an adhesion portion R. Thus, the sealing member 253 is formed by the opening sealing member 502 for closing the openings 251*h*, and the fixing member 501 fixed to the unsealing member 254. The opening sealing member 502 and the fixing member 501 are adhered to each other.

Sealing Member Removing Process

As illustrated in FIG. 28, the user pulls out the sealing member 253 wound around the unsealing member 254 in the direction indicated by the arrow U1, and then separates the fixing member 501 and the opening sealing member 502.

The force required to separate the fixing member 501 and the opening sealing member 502 is only required to be larger than the force required to detach the opening sealing member 502 from the flexible container 251. Further, the force required to separate the fixing member 501 and the unsealing member 254 is only required to be larger than the force required to separate the fixing member 501 and the opening sealing member 502. In the assembling process after refilling the developer, it is not necessary to reattach the removed opening sealing member 502.

Ninth Embodiment

In the fifth embodiment, the detailed description has been given of a case in which the developing roller 6 and the developing blade 31 are removed in the disassembling process of the developing unit 9. In the ninth embodiment, a case in which the developing roller 6 and the developing blade 31 are not removed in the disassembling process of the developing unit 9 is described. First of all, similar to the above descriptions, after the unit separation process, the user separates the developing unit 9 from the cartridge P.

In this case, as illustrated in FIG. 22 described above, the user forms, on the frame member 29, the filling port 29*r* as a hole for removing the sealing member 253 and for refilling the developer. More specifically, the user forms, on the frame member 29, the filling port 29*r* as a "frame member communication hole", and removes at least the sealing member 253 through the filling port 29*r*. A hole may be formed anywhere on the frame member 29 as long as the sealing member 253 can be removed and the developer can be refilled through the filling port 29*r* of the frame member 29 and the openings 251*h* of the flexible container 251.

The filling port 29*r* may have any shape as long as the sealing member 253 can be taken out therefrom, and as long as the tip portion 201*a* of the funnel 201 (described below) can be inserted therein. The method for removing the sealing member 253 is similar to that according to the first embodiment.

Developer Refilling Process

As illustrated in FIG. 22, the user inserts the tip portion 201*a* of the funnel 201 into the flexible container 251 through the filling port 29*r* and the openings 251*h* of the flexible container 251, and then refills the developer.

FIG. 23 is a sectional view of the developing unit 9 in which the developer is refilled. As illustrated in FIG. 23, the user seals the filling port 29*r* of the frame member 29 using the hole sealing member 300. As the hole sealing member 300, an adhesive tape, a plastic plate with an adhesion layer, etc. can be desirably used. In the subsequent processes, the user combines the unit in reverse order of the unit separation process to complete the assembling process.

Tenth Embodiment

Developing Unit Assembling Process

Figure 29:
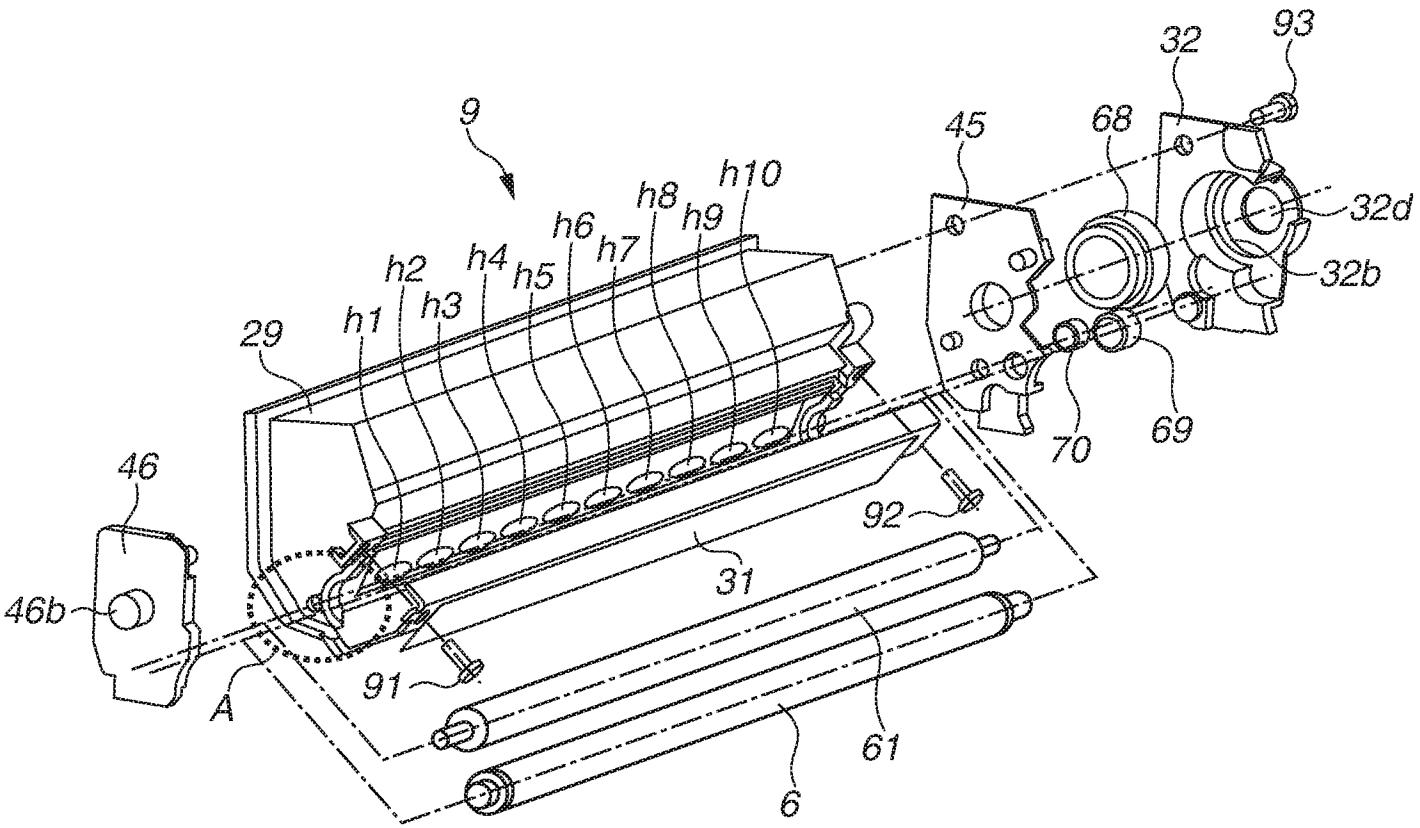
FIG. 29 is an exploded perspective view illustrating the developing unit.
Figure 30A:
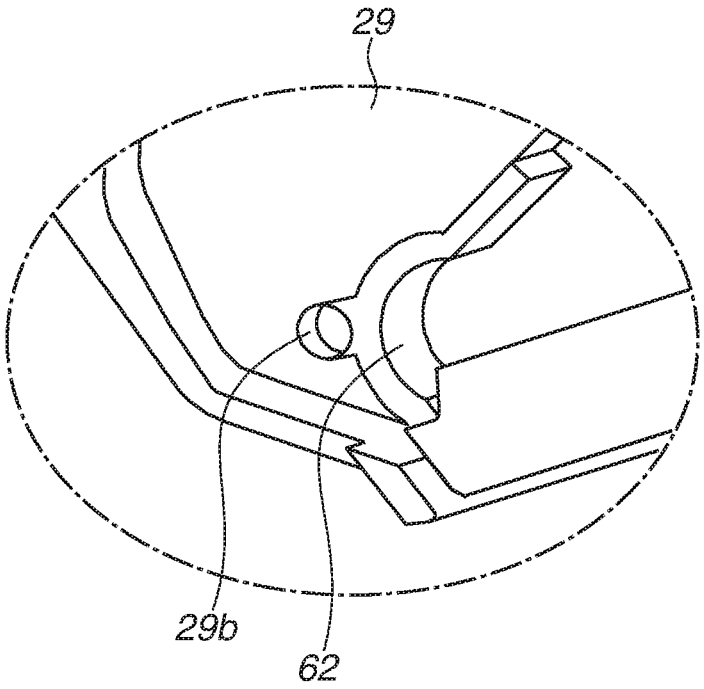
FIGS. 30A and 30B are enlarged views illustrating a non-drive side portion of the frame member (a portion A illustrated in FIG. 29).
Figure 30B:
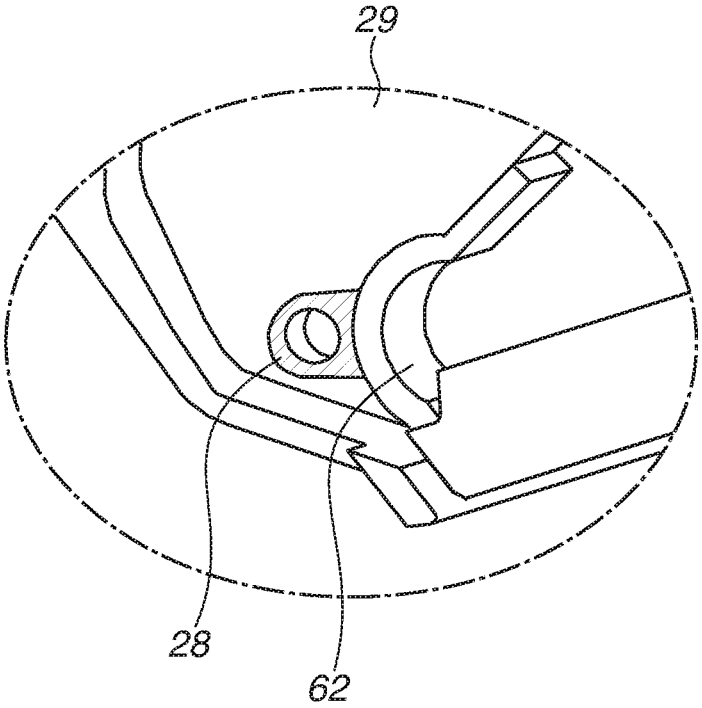

FIG. 29 is an exploded perspective view illustrating the developing unit 9. Then, the user separates a supply roller 61 from the frame member 29. FIGS. 30A and 30B are enlargement views illustrating the non-drive side portion of the frame member 29 (a portion A illustrated in FIG. 29). As illustrated in FIG. 30A, a hole 29*b* into which the shaft of the supply roller 61 is to be fitted is formed on the frame member 29. When the gap between the shaft of the supply roller 61 and the frame member 29 is sealed by the end seals 62, the user removes the end seals 62 and then separates the supply roller 61 from the frame member 29.

The user may perform the removing process of both of the respective end seals 62 of the drive side and the non-drive side, the method is not limited thereto. For example, the user may perform only the removing process of the end seal 62 on the non-drive side and then pull out the supply roller 61 toward the non-drive side to separate it from the frame member 29. Although, in the above descriptions, the shaft of the supply roller 61 is fitted into the hole 29*b* of the frame member 29, the configuration is not limited thereto. The supply roller 61 may be fixed to the frame member 29 through a fixing member 28 of the supply roller 61 (refer to FIG. 30B).

In this case, the user separates the fixing member 28 from the frame member 29 and then separates the supply roller 61 from the frame member 29. The user may perform the process for separating the fixing member 28 from the frame member 29 both on the non-drive side and the drive side or only on either one of the non-drive side and the drive side. For example, when the user performs a removing process of the fixing member 28 only on the non-drive side, the user is able to separate the supply roller 61 from the frame member 29 by pulling out the supply roller 61 toward the non-drive side. Upon completion of the above-described procedure, the disassembling process of the developing unit 9 is completed, allowing the developer to be refilled.

Opening Enlargement Process

FIGS. 31A, 31B, 31C, and 31D are perspective views of the flexible container 251 illustrating an enlargement process for enlarging a plurality of openings 251*h*1 to 251*h*10 of the flexible container 251. The remanufacturing method includes an opening processing process for processing the openings 251*h* so as to enlarge the openings 251*h*, before the refilling process. The opening processing process connects the plurality of openings 251*h*.

Figures 31A, 31B, 31C, 31D:
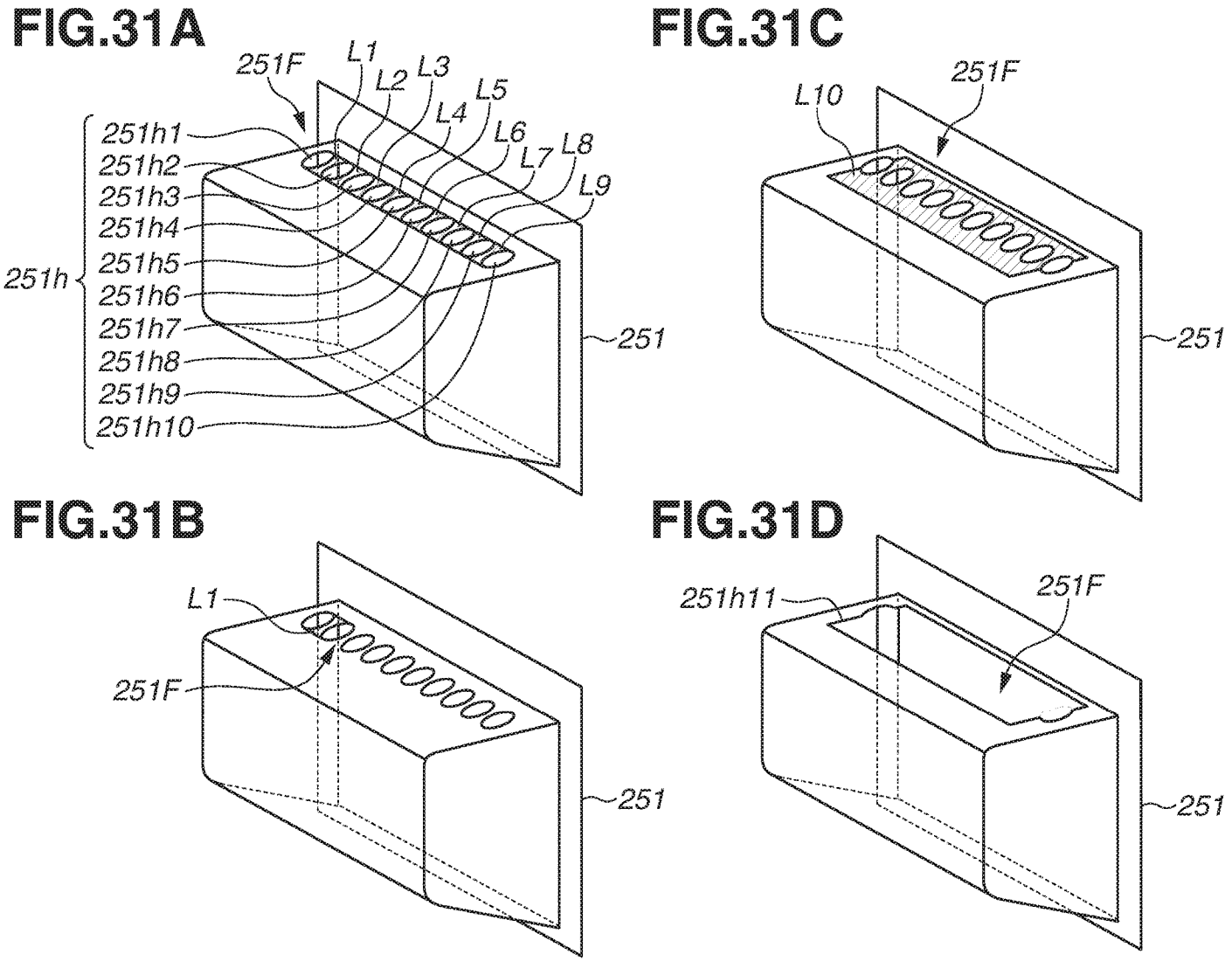
FIGS. 31A, 31B, 31C, and 31D are perspective views of the flexible container illustrating an enlargement process for enlarging an opening of the flexible container.

As illustrated in FIG. 31A, a certain method cuts off all of connecting portions L1 to L9 between the openings 251*h*1 to 251*h*10 of the flexible container 251. As illustrated in FIG. 31B, another method cuts off only the connecting portion L1 among the connecting portions L1 to L9 between the openings 251*h*1 to 251*h*10 of the flexible container 251.

As illustrated in FIG. 31C, still another method cuts off a large area including the connecting portions L1 and L9 between the openings 251*h*1 to 251*h*10 of the flexible container 251 to form an opening L10. As illustrated in FIG. 31D, substantially similar to FIG. 31C, still another method cuts off a large area to form an opening 251*h*11. In this case, the opening processing process forms the opening 251*h*11 larger than an area including all of the plurality of openings 251*h*. The opening after the processing may have any shape as long as it is enlarged to be larger than the opening before the processing. In the following descriptions, the opening after the processing is referred to as a refilling opening 251F.

Developer Refilling Process

Figure 32:
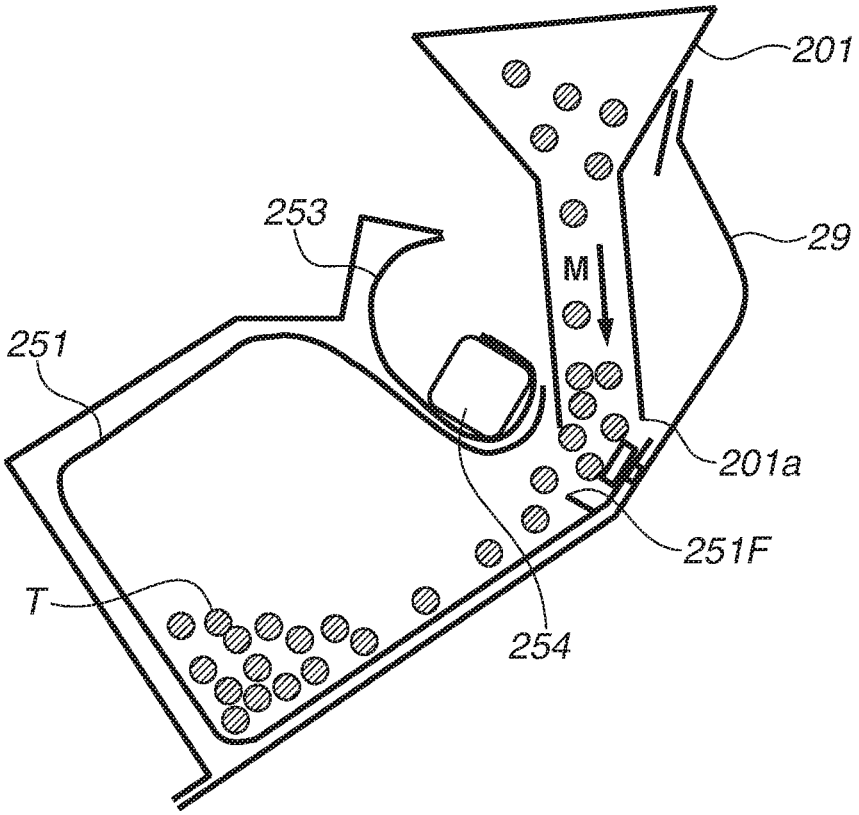
FIG. 32 is a sectional view of the frame member illustrating a process for refilling the developer through a refilling opening.

FIG. 32 is a sectional view of the frame member 29 illustrating a process for refilling the developer through the refilling opening 251F. As illustrated in FIG. 32, when refilling the developer, the frame member 29 is disposed so that the refilling opening 251F is oriented vertically upward. The funnel 201 used for refilling the developer has such a cross-sectional area of the tip portion 201*a* as to be fitted into the size of the enlarged refilling opening 251F. The tip portion 201*a* of the funnel 201 is inserted into the flexible container 251 through the refilling opening 251F in the direction indicated by an arrow M.

The user pours the developer T into the funnel 201 from, for example, a toner bottle (not illustrated) to refill the developer T into the flexible container 251 and into the frame member 29. Although, in the present embodiment, the funnel 201 used has a cross-sectional area of the tip portion 201*a* according to the size of the refilling opening 251F, the refilling opening 251F may be enlarged according to the size of the funnel 201.

As described above, since the refilling opening 251F has a larger opening area than the openings 251*h*1 to 251*h*10 of the new flexible container 251, the tip portion 201*a* of the funnel 201 can have a large cross-sectional area. This enables efficient refilling of toner in a shorter time.

When the developer T is refilled without enlarging an opening, the user needs to use the funnel 201 having a small cross-sectional area of the tip portion 201*a* according to the size of the opening. Therefore, the developer will stagnate in the tip portion 201*a* of the funnel 201, prolonging the time of refilling. Further, when refilling the developer T having high cohesiveness, the tip portion 201*a* of the funnel 201 will be clogged with the developer, making it impossible to refill the developer.

When an opening is extremely small, the tip portion 201*a* of the funnel 201 cannot be inserted into the flexible container 251. If the user performs the refilling process without inserting the tip portion 201*a* of the funnel 201 into the flexible container 251, almost none of the refilled developer is filled into the flexible container 251, and only a very small capacity inside the frame member 29 and outside the flexible container 251 is filled with the developer. As a result, the developer refilling may not be sufficiently completed.

Developing Unit Assembling Process and Unit Combining Process

After refilling the developer into the flexible container 251 in this way, the user performs the assembling process of the developing unit 9, and the combining process of the photosensitive unit 8 and the developing unit 9. Upon completion of the above-described procedure, the assembling process of the cartridge P is completed as illustrated in FIG. 3. The above-described remanufacturing method of the cartridge P enables achievement of a simplified remanufacturing method of the cartridge P.

Eleventh Embodiment

Opening Enlargement Process

Figure 33A:
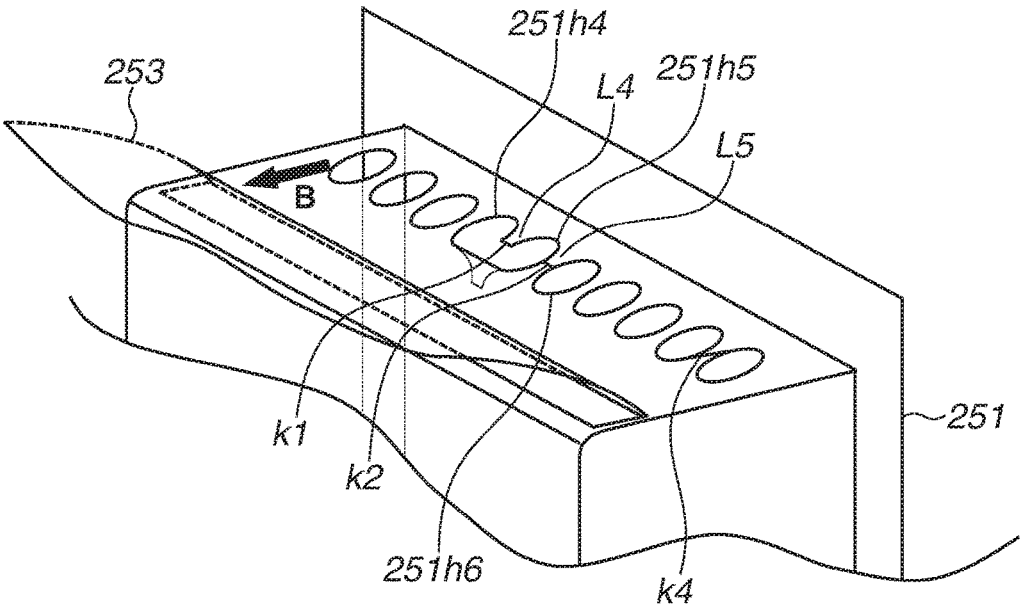
FIGS. 33A and 33B are perspective views of the flexible container illustrating the enlargement process for enlarging an opening of the flexible container according to an eleventh embodiment.

FIG. 33A is a perspective view of the flexible container 251 illustrating an enlargement process for enlarging an opening of the flexible container 251 according to the eleventh embodiment. On the flexible container 251, a cutoff line k1 is preprocessed at the connecting portion L4 between the openings 251*h*4 and 251*h*5. In the opening enlargement process, an opening is enlarged by cutting off the cutoff line k1. In the opening processing process, at least one of the plurality of openings 251*h* is processed. Further, a plurality of cutoff lines may be processed at connecting portions. For example, a cutoff line k2 may be processed at the connecting portion L5 between the openings 251*h*5 and 251*h*6, in addition to the cutoff line k1.

However, the cutoff lines k1 and k2 need to be left uncut when the sealing member 253 is wound up by the unsealing member 254. Therefore, rather than processing the cutoff lines k1 and k2 in the direction perpendicular to the direction indicated by the arrow B in which the sealing member 253 is wound up, it is better to process a cutoff line k4 in such a direction that forms a small angle with respect to the direction of the arrow B in which the sealing member 253 is wound up. However, the winding direction and the cutoff line direction are not limited thereto. The tension required to cut off the cutoff lines is only required to be larger than the tension applied to the cutoff lines while the sealing member 253 is being wound up.

Figure 33B:
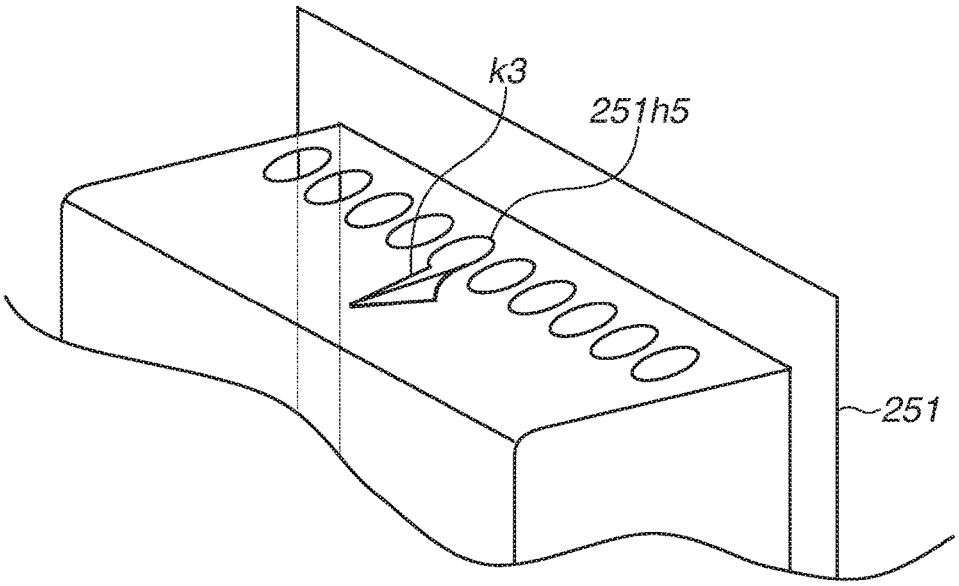

FIG. 33B is a perspective view of the flexible container 251 illustrating a cutoff line k3 according to a modification. As illustrated in FIG. 33B, the cutoff line k3 extending in the direction indicated by the arrow B and connecting with the opening 251*h*5 may be processed on the surface of the flexible container 251.

The cutoff line preprocessed on the flexible container 251 is only required to enlarge an opening by being cut off in the opening enlargement process. The number and shape of cutoff lines are not limited. Likewise, an opening can be enlarged by cutting off at least one cutoff line in the opening enlargement process. Therefore, the user does not need to cut off all of the processed cutoff lines. The subsequent developer refilling process is similar to that according to the tenth embodiment, and descriptions thereof will be omitted.

Twelfth Embodiment

Refilling Opening Processing Process

Figure 34A:
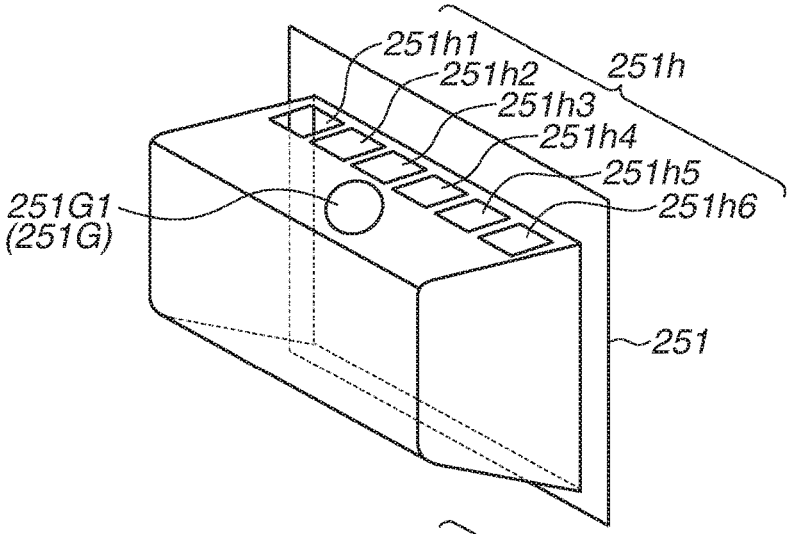
FIGS. 34A, 34B, and 34C are perspective views of the flexible container illustrating a process for processing a refilling opening on the flexible container fixed to the inside of the frame member.
Figure 34B:
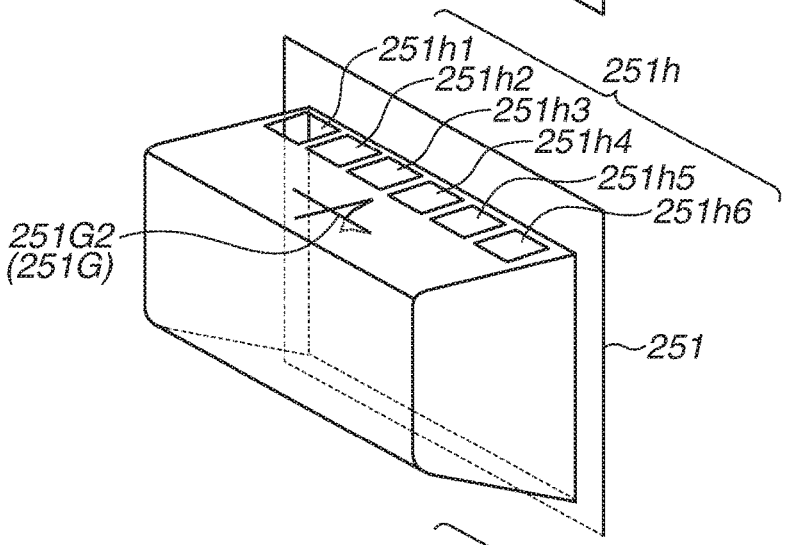
Figure 34C:
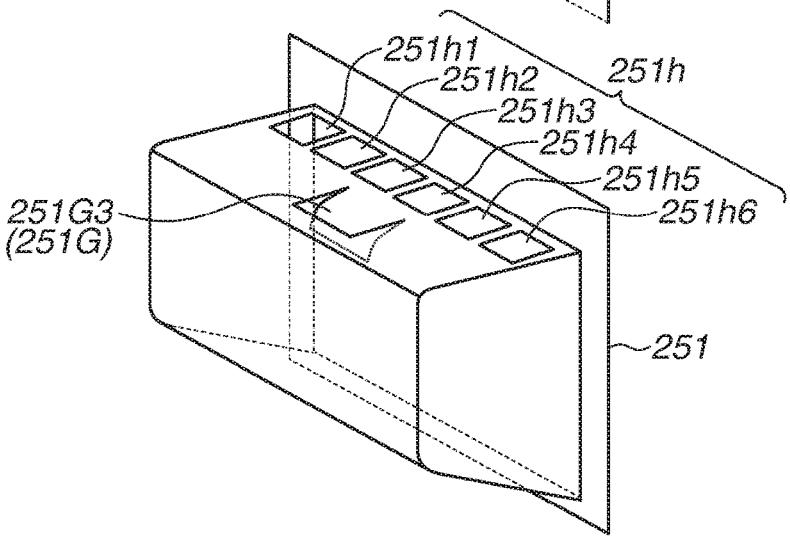

FIGS. 34A, 34B, and 34C are perspective views of the flexible container 251 illustrating a processing process for processing a refilling opening 251G on the flexible container 251 fixed to the inside of the frame member 29. As described above, when the disassembly of the developing unit 9 is completed, the flexible container 251 is exposed. In this case, the refilling opening 251G is processed on the exposed flexible container 251. This enables the developer to be refilled into the flexible container 251 through the refilling opening 251G.

The refilling opening 251G may be a round through hole 251G1 as illustrated in FIG. 34A, a cross-shaped cut portion 251G2 as illustrated in FIG. 34B, or a U-shaped cut portion 251G3 as illustrated in FIG. 34C.

Further, the refilling opening 251G may have any shape as long as the funnel 201 (described below) can be inserted therein, and may be a through hole such as a square hole, or a cut portion such as a straight line cut portion. It is desirable to form the refilling opening 251G so large as to allow communication between the inside and the outside of the flexible container 251 more than one of the openings 251*h* (251*h*1 to 251*h*6) on the flexible container 251 does. Forming the large refilling opening 251G enables a more efficient developer refilling process.

Developer Refilling Process

Figure 16:
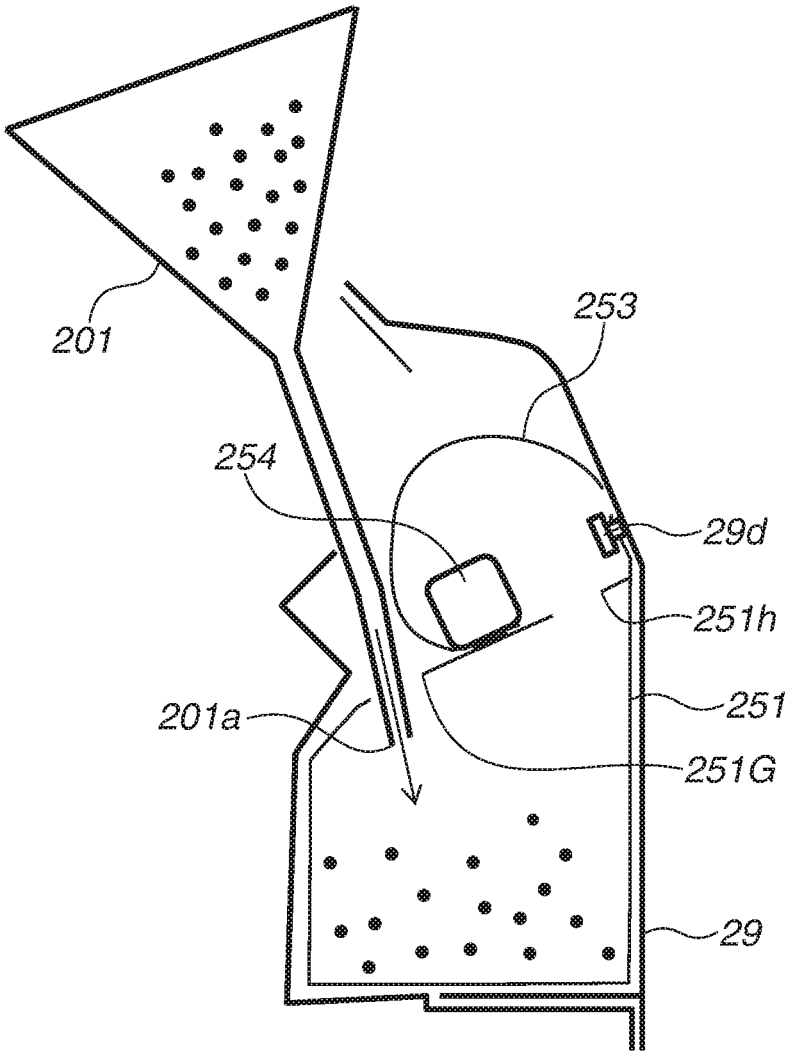
FIG. 16 is a sectional view illustrating a process for refilling the developer.

Then, the user performs the developer refilling process, which has been described above with reference to FIGS. 15, 17, and 18. When injecting compressed air into the flexible container 251, any one of the refilling openings 251G illustrated in FIGS. 34A, 34B, and 34C may be used. As illustrated in FIGS. 34A, 34B, and 34C, the tip portion 201*a* of the funnel 201 is inserted into the refilling opening 251G of the flexible container 251 (refer to FIG. 16). The user refills the developer into the flexible container 251 by dropping the developer into the funnel 201 from a developer bottle (not illustrated). In addition, using a fixed-rate feeding device having an auger in the funnel-shaped main body enables efficient refilling of the developer.

Developing Unit Assembling Process

Subsequently, the user performs the assembling process of the developing unit 9 and the unit combining process of the photosensitive unit 8 and the developing unit 9. Upon completion of the above-described procedure, the assembling process of the cartridge P is completed as illustrated in FIG. 3. The above-described remanufacturing method of the cartridge P enables achievement of a simplified remanufacturing method of the cartridge P.

Thirteenth Embodiment

In the twelfth embodiment, the detailed description has been given of a case in which the refilling opening 251G is formed on the flexible container 251 without removing the sealing member 253, and then the developer is refilled. In the thirteenth embodiment, a description will be given of a case in which the refilling opening 251G is formed on the flexible container 251 after removing the sealing member 253, and then the developer is refilled.

Sealing Member Removing Process

Figure 19:
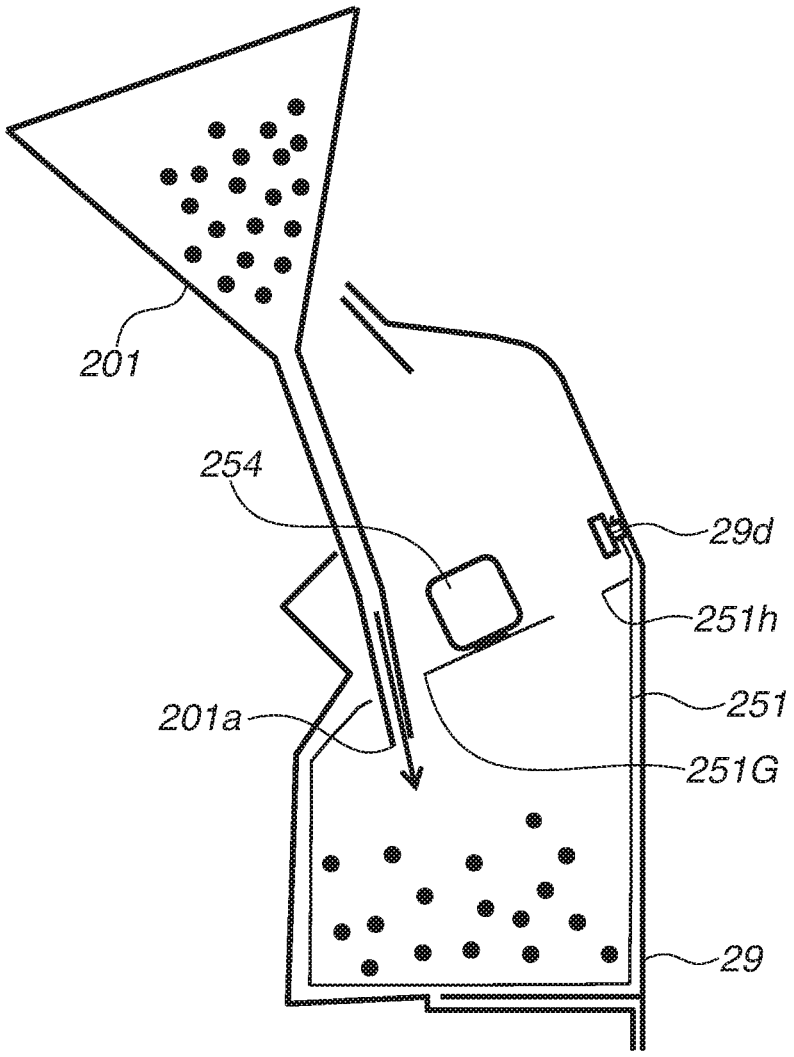
FIG. 19 is a sectional view illustrating a process for refilling the developer.

As described above with reference to FIG. 24, the user may remove the sealing member 253 and then perform the refilling process. More specifically, at least a part of the sealing member 253 is removed (removing process) before the refilling process. After removing the sealing member 253, the user forms any one of the refilling openings 251G illustrated in FIGS. 34A, 34B, and 34C on the flexible container 251, and then performs the developer refilling process as illustrated in FIG. 19. More specifically, the refilling opening 251G as "another opening" different from the openings 251*h* is processed on the flexible container 251 (another opening process) before the refilling process. In addition, the refilling opening 251G is processed to be larger than the openings 251*h*.

In the assembling process after refilling the developer, the user does not need to reattach the removed sealing member 253. As in the present embodiment, removing the sealing member 253 enables a more efficient developer refilling process.

Fourteenth Embodiment

In the first embodiment, the detailed description has been given of a case in which the developing blade 31 and the like are separated from the frame member 29 to expose the flexible container 251. In the fourteenth embodiment, the description will be given of a case in which only the developing blade 31 is separated from the frame member 29 and then the developer is refilled into the flexible container 251.

Developing Blade Disassembling Process

To separate only the developing blade 31 from the frame member 29, the user disassembles only the developing blade 31 without disassembling members excluding the developing blade 31 in the disassembling process of the developing unit 9 described with reference to FIG. 29 in the tenth embodiment. In the developing unit 9 in which the developing blade 31 as a "regulating member" for regulating the layer thickness of the developer on the developing roller 6 is attached to the frame member 29, only the developing blade 31 is separated from the frame member 29 (separation process) before the another opening process. When the developing blade 31 is fixed to the frame member 29 with the screws 91 and 92, the screws 91 and 92 are removed and then the developing blade 31 is separated from the frame member 29.

After separating the developing blade 31 from the frame member 29, any one of the refilling openings 251G as illustrated in FIGS. 34A, 34B, and 34C is formed on the flexible container 251, and then the developer refilling process as illustrated in FIG. 19 is performed. In addition, the sealing member 253 may be removed after separating the developing blade 31. Alternatively, the unsealing member 254 may be rotated to expose the flexible container 251, without removing the sealing member 253. In the present embodiment, separating only the developing blade 31 from the frame member 29 enables a more simple developer refilling process.

According to the configurations of the first to the fourteenth embodiments, the remanufacturing method of the developing unit 9 is simplified as compared with the conventional technique. The configurations or processes according to the first to the fourteenth embodiments can be suitably combined.

Although, in the first to the fourteenth embodiments, the description has been given of the cartridge P including the developing unit 9 and the photosensitive unit 8, the configuration is not limited thereto as long as it includes the developing unit 9. In other words, the first to the fourteenth embodiments are also applicable to a developing device, a cartridge, and an image forming apparatus as long as these include the developing unit 9.

According to an embodiment of the present invention, it is possible to provide a remanufacturing method of a developer accommodating unit including a flexible container.

While the present invention has been described with reference to embodiments, it is to be understood that the invention is not limited to the disclosed embodiments. The scope of the following claims is to be accorded the broadest interpretation so as to encompass all such modifications and equivalent structures and functions.

What is claimed is:

1. A remanufacturing method of a cartridge, the cartridge comprising a flexible container and detachably mountable to an image forming apparatus, the remanufacturing method comprising:

filling a used flexible container with developer, the used flexible container being configured to accomodate developer and provided with a plurality of openings for discharging developer; and attaching a sealing member to an outside surface of the used flexible container such that the sealing member covers the plurality of openings.

2. The remanufacturing method according to claim 1, wherein the used flexible container comprises a developer accommodating portion for accommodating developer, and the used flexible container is deformable to change a capacity of the developer accommodating portion.

3. The remanufacturing method according to claim 1, wherein the remanufacturing method comprises removing at least part of a frame member for accommodating the used flexible container such that at least part of the used flexible container is exposed.

4. The remanufacturing method according to claim 1, wherein the used flexible container is a flexible container with developer consumed.

5. The remanufacturing method according to claim 1, wherein the remanufacturing method comprises attaching an image bearing member for bearing a latent image to the cartridge.

6. The remanufacturing method according to claim 1, wherein the remanufacturing method comprises attaching a developer bearing member for developing a latent image to the cartridge.

7. A cartridge detachably mountable to an image forming apparatus comprising:

an used flexible container configured to accommodate developer and provided with a plurality of openings for discharging developer;

developer filled in the used flexible container; and a sealing member bonded to an outside of the used flexible container such that the plurality of the openings are covered by the sealing member.

8. The cartridge according to claim 7, wherein the used flexible container comprises a fixed portion being provided with a plurality of the holes.

9. The cartridge according to claim 7, wherein the used flexible container comprises a developer accommodating portion for accommodating developer, and the used flexible container is deformable to change a capacity of the developer accommodating portion.

10. The cartridge according to claim 7, wherein the used flexible container is a flexible container with developer consumed.

11. The cartridge according to claim 7, wherein the cartridge includes an image bearing member for bearing a latent image.

12. The cartridge according to claim 7, wherein the cartridge includes a developer bearing member for developing a latent image.

13. A cartridge detachably mountable to an image forming apparatus comprising:

developer filled in an used flexible container being configured to accommodate developer and provided with a plurality of openings for discharging developer, wherein the plurality of the openings are covered by a sealing member bonded to an outside of the used flexible container.

14. The cartridge according to claim 13, wherein the used flexible container comprises a fixed portion being provided with a plurality of holes.

15. The cartridge according to claim 13, wherein the used flexible container comprises a developer accommodating portion for accommodating developer, and the used flexible container is deformable to change a capacity of the developer accommodating portion.

16. The cartridge according to claim 13, wherein the used flexible container is a flexible container with developer consumed.

17. The cartridge according to claim 13, wherein the cartridge includes an image bearing member for bearing a latent image.

18. The cartridge according to claim 13, wherein the cartridge includes a developer bearing member for developing a latent image.

* * * * *